US007481137B1

(12) United States Patent
Johnson

(10) Patent No.: US 7,481,137 B1
(45) Date of Patent: Jan. 27, 2009

(54) TOOL LUG AND LOCKING SYSTEM

(76) Inventor: Robyn Marie Johnson, 12 Farley Rd., Milford, CT (US) 06460

( * ) Notice: Subject to any disclaimer, the term of this patent is extended or adjusted under 35 U.S.C. 154(b) by 41 days.

(21) Appl. No.: 11/392,138

(22) Filed: Mar. 29, 2006

(51) Int. Cl.

| | |
|---|---|
| ***B26B 3/06*** | (2006.01) |
| ***F41B 13/02*** | (2006.01) |
| ***F41C 27/18*** | (2006.01) |
| ***B25B 23/00*** | (2006.01) |
| ***B25B 23/16*** | (2006.01) |
| ***B25B 11/00*** | (2006.01) |
| ***B25G 1/08*** | (2006.01) |

(52) U.S. Cl. ..... 81/440; 81/177.8; 81/177.4; 7/118; 30/161

(58) Field of Classification Search ..... 30/161; 81/440, 177.4, 177.6, 439; 7/118, 162
See application file for complete search history.

(56) References Cited

U.S. PATENT DOCUMENTS

| | | | | |
|---|---|---|---|---|
| 1,398,583 | A | 11/1921 | Bovee | |
| 1,787,424 | A * | 1/1931 | Altenbach | 7/168 |
| 2,804,970 | A | 9/1957 | Kuc et al. | |
| 3,061,927 | A | 11/1962 | Von Frankenberg | |
| 3,364,508 | A * | 1/1968 | Garrett | 7/118 |
| 4,261,103 | A * | 4/1981 | Heck | 30/159 |
| 4,384,499 | A | 5/1983 | Shockley | |
| 5,062,173 | A | 11/1991 | Collins et al. | |
| 5,146,815 | A | 9/1992 | Scott, III | |
| 5,271,300 | A | 12/1993 | Zurbuchen et al. | |
| 5,320,004 | A | 6/1994 | Hsiao | |
| 5,450,774 | A | 9/1995 | Chang | |
| 5,581,834 | A * | 12/1996 | Collins | 7/118 |
| 5,592,859 | A | 1/1997 | Johnson et al. | |
| 5,669,492 | A * | 9/1997 | Chao | 206/234 |
| 5,711,042 | A | 1/1998 | Chuang | |
| 5,711,194 | A * | 1/1998 | Anderson et al. | 81/440 |
| 5,791,211 | A | 8/1998 | Bondhus et al. | |
| 5,802,936 | A * | 9/1998 | Liu | 81/450 |
| 5,927,164 | A * | 7/1999 | Anderson et al. | 81/440 |
| 5,970,553 | A | 10/1999 | Lin | |
| 5,970,828 | A | 10/1999 | Bondhus et al. | |
| 6,085,620 | A * | 7/2000 | Anderson et al. | 81/440 |
| 6,109,147 | A * | 8/2000 | Legg | 81/440 |
| 6,119,560 | A * | 9/2000 | Anderson et al. | 81/440 |
| 6,128,981 | A | 10/2000 | Bondhus et al. | |
| 6,131,222 | A * | 10/2000 | Anderson et al. | 7/105 |
| 6,243,901 | B1 * | 6/2001 | Elsener et al. | 7/118 |
| 6,257,106 | B1 * | 7/2001 | Anderson et al. | 81/440 |
| 6,286,168 | B1 | 9/2001 | Woodruff et al. | |
| 6,286,397 | B1 * | 9/2001 | Taggart et al. | 81/63.1 |
| 6,298,756 | B1 * | 10/2001 | Anderson et al. | 81/440 |
| 6,397,709 | B1 * | 6/2002 | Wall | 81/440 |

(Continued)

*Primary Examiner*—Joseph J Hail, III
*Assistant Examiner*—Alvin J Grant
(74) *Attorney, Agent, or Firm*—Fattibene and Fattibene; Paul A. Fattibene; Arthur T. Fattibene

(57) ABSTRACT

A folding hand tool containing a plurality of elongated tools mounted on a predetermined sized lug and pivotally held in a handle. Shaped complementary sidewalls on the lugs placed adjacent one another provide locking means for positively positioning the plurality of elongated tools in an open or used position. The shaped complementary sidewalls on adjacent lugs may be selectively disengaged with a release or by overcoming a bias of an engaging force. The predetermined sized lugs provide improved transmission of forces and easier manufacture.

23 Claims, 19 Drawing Sheets

U.S. PATENT DOCUMENTS 6,637,061 B1 * 10/2003 Spracklin et al. ..... 7/138
6,868,760 B1 3/2005 Johnson
7,047,847 B2 * 5/2006 Chuang ..... 81/440
D528,395 S * 9/2006 Schluter ..... D8/86
7,185,569 B2 * 3/2007 Knight et al. ..... 81/450
D542,111 S * 5/2007 Te ..... D8/105

* cited by examiner

TOOL LUG AND LOCKING SYSTEM

FIELD OF THE INVENTION

This invention relates to methods of producing a Folding Handtool Kit instrument that is characterized as a plurality of elongated tools. Each elongated tool having a extended tool working end and a lug based aft end in which any particular tool is selected by pivoting the tool around a shaft that is secured within the confines of a handle and from a retracted closed position for storage within the confines of the handle to an extended open position for use. The extended tool and lug based aft end are produced by separate manufacturing means in order to better employ and broaden flexibility in design especially as it relates to producing a stronger and more secure extended tool and the integration of locking mechanisms with the extended tool.

BACKGROUND OF THE INVENTION

Folding Hand Toolkits consisting of elongated tools have long been used by tradesmen and homeowners alike. These toolkits comprise of a plurality of related tools arranged in an assortment of sizes for a given tool type such as screwdrivers, hex wrenches and Torx® drivers or arranged as a variety of tools each with different functions that might be used to perform a given undertaking such as sets of common elongated tools for repairing a bicycle or tools commonly used by fishermen. It is conceivable that Folding Hand Toolkits can be produced to benefit any conceivable sport, hobby or trade. The tradesmen and homeowners are benefited with the convenience of an organized set of tools situated in a common holder to perform the task at hand.

Folding Hand Toolkits have been developed utilizing various types of containment handles usually made of metal and/or plastics. Some toolkits have freely pivoting elongated tools some are equipped with locking mechanisms to saddle or secure an elongated tool in an extended position for use.

A common feature of Folding Hand Toolkit is that the pivoting portion of the traditional elongated tool has been manufactured to produce the desired pivoting effect by deformation of an extended tool shaft through a manufacturing operation commonly called looping in which the extended tool shaft is bent into a circular configuration to conform to the stationary shaft on which it pivots around. This extended tool that has been looped is called an elongated tool.

Common faults and criticisms of Folding Hand Toolkits of this nature are that over time and use, the mounted elongated tools become loose and floppy. Among the reasons for this phenomenon is that in their general application and use the elongated tools are subject to a high degree of torque; other reasons are due to wear factors. When the elongated tools are placed in an application that results in high torsion the elongated tool in use is acting against the side walls of the handle, the stationary shaft that they pivot around and the other elongated tools that are mounted on the same stationary shaft. Often there is inadequate support from one size elongated tool to an adjacent elongated tool of a different size or function in the same Folding Hand Toolkit. Inventions and techniques addressing this situation have been employed by Hand Toolkit inventors, designers and manufacturers to prevent or minimize the loosing up of the elongated tools. Among the solutions to oppose subject forces acting at the base aft end of the elongated tools that have been proposed by inventers, designers and manufacturers are to:

- Minimize the number of assembled pieces the handle is made of so that it will possibly flex less.
- Adding convoluted and/or gusseted structures to the handle for additional strength.
- Using high strength thermoplastics plastics sometimes reinforced with fiber materials in the handle section of the tool kit for additional resistance to deform under high loads.
- Supplying adjustment capabilities such as a screw adjustment of the stationary shaft so that as parts wear and deform the slack can be taken up by improving alignment and/or increased compression from the side walls of the handle.
- Usually the looped base aft end of the elongated tool that is in use is applying forces against the elongated tool that is positioned adjacent to it. However in most instances the looped surface of one elongated tool does not mate and uniformly support against the surface of the next elongated tool due to the cross sectional size difference of the substrate stock each tool is made of. To improve this situation metal or plastic washers (spacers) placed separately or molded into a handle have been incorporated to more uniformly distribute the applied loads between each elongated tool and between the handle side walls and stationary shaft. They also assist in keeping the elongated tools aligned.

Inherent in the design and manufacture of traditional looped elongated tools is the looped base forms an incomplete and unsupported tail section of the aft end of the elongated tool. The primary functions of the looped tails are to provide a surface for radial and axial loading and to provide sufficient encompassing of the base tail section at the aft end of the elongated tool that has been mounted on a stationary shaft to prevent the elongated tool from dislodging from its pivoting location. Consequently when a high torque application is applied, the aft end looped tail base of the elongated tool is subject to torsion forces. These forces can deform the looped base tail section in two ways; the first being that the radial axis can be bent into a helical form; the second is that the looped tail of the elongated tool can deform by the opening of its original diameter thus deforming by bowing the looped tail, increasing the original diameter or producing an oblong shape. In either case when the looped tail is deformed from, its original intended dimension in high torque applications deformation due to the resulting torsion often results. The outcome can be a loose and floppy fitting elongated tool.

Long-established methods using looping techniques have been found to be inflexible in their inherent design and often costly when integrated with the handle sections of a Folding Hand Toolkit. An example can be illustrated when design consideration is given to producing a standard array of both metric hex keys and fractional hex keys for a Folding Hand Toolkit. A standard set of hex keys is most easily and most commonly produced from standard sized hexagon stock. The stock is simply cut to length, looped to a specific inside diameter and then proceeds with various deburring, heat treating and finishing operations to produce a functional elongated tool. In most cases when the arrays of sizes are assembled within the confines of the handle they are arranged in a descending order of size. It is common that several of the larger sizes be assembled on one side of the handle and that the smaller sizes are assembled on the opposite side of the handle. A typical configuration for a Folding Hand Toolkit for common metric hex key include sizes 8 mm, 6 mm and 5 mm located on one side of the handle and 4 mm, 3 mm, 2.5 mm, 2 mm and 1.5 mm located on the opposite side. Adding the dimensions for the first side of the handle the sum is 19 mm (or 0.74803 in.) and 13 mm (or 0.51181 in.) on the opposite side. A typical configuration for a Folding Hand Toolkit for common fractional hex key sizes in a Folding Hand Toolkit includes sizes 1/4 in., 7/32 in., 3/16 in on one side of the handle. The opposite side of the handle is fitted with 5/32 in., 9/64 in., 1/8 in., 7/64 in., 3/32 in., and 5/64 in. and when you add the dimensions for each side of the handle the sum is 0.65625 in. (or 16.67 mm) on one side and 0.70312 in. (or 17.86 mm) on the opposite side. This example makes clear that design consideration has to be made to accommodate the difference in the width of the handles to have capacity for the variety of elongated tool combinations. What is illustrated is that when comparing just two similar in function Hand Toolkits, that when designing the handle sections of each side of both the metric hex key sizes and fractional hex key sizes, consideration must be made to the dimensions of each side. There is little dimensional commonality between one seemingly similar Folding Hand Toolkit to the next.

The inflexibility in design is further amplified when considering the small number of Folding Hand Toolkits that are equipped with tool locking mechanisms. When a Folding Hand Toolkit is equipped with a locking mechanism and experiences torsion deformation of the pivoting base looped tail of the elongated tool from its original intended dimensions the function of the locking mechanism becomes increasingly problematic. In most circumstances the Locking Folding Hand Toolkits require more accurate tolerances during the manufacturing process. The design of a Locking Folding Hand Toolkits dictates that the tolerance integrity is maintained for the life of the toolkit.

SUMMARY OF THE INVENTION

The object of this invention pertains to a better method for manufacturing and attaching a plurality of elongated tools to a Folding Hand Toolkit than methods that have been used previously. The invention calls for the use of a Lug that when properly designed and attached to the aft end an extended tool will replace previous methods of manufacturing elongated tools as well as minimize or eliminate the common faults and criticisms previously listed to Folding Hand Toolkits. A Lug is defined as a component of an elongated tool that act as its aft end base. It is manufactured through means other than the techniques used to produce the looped base of an elongated tool. The lug is made integral with an extended tool so as to act as its supportive base on the aft end of the extended tool and for the purpose of attaching the extended tool to the handle section of a Folding Hand Toolkit. The manufacturing method of producing a Lug can be but is not limited to injection molding, die-casting, machining or stamping operations. The materials that can be used for manufacturing a Lug can be but not limited to: thermoplastics, fiber reinforced thermoplastics, metals, powder metals, ceramic or a ceramic matrix. Different materials and manufacturing techniques can be selected to best suit the application and functionality of any specific Folding Hand Toolkit. Regardless of the manufacturing techniques or materials used, the common features of a Lug defined in this invention is that it acts as the supportive base located at the aft end of an elongated tool where as the Lug base is of a configuration designed to produce a pivoting effect for the aft end section of the elongated tool when assembled on the stationary shaft of a Folding Hand Toolkit.

The advantages of utilizing a lug over traditional methods of producing Folding Hand Toolkits using looping techniques for the aft end of an elongated tool base is that it offers tremendous flexibility in design as compared to previously used methods. For the purpose of clearly defining the advantages of this invention, injection molding using thermoplastics will be exemplified as a manufacturing technique for producing a Lug based Folding Hand Toolkit.

The first basic embodiment of the present invention is directed to an injection molded lug that will have an elongated tool either molded into the lug or the lug will be provided with a properly sized hole to press fit an elongated tool into it. Assembling of the lug with an extended tool forms a single component and results in a combined or amalgamated elongated tool and thus renders the lug end of the elongated tool to be the aft end and base and the extended tool section to be the working end of the elongated tool. For purpose of identification in the description of this invention the amalgamated assembly of the elongated tool and lug will be called an elongated lug-tool.

A further embodiment of the present invention is that the makeup of a Folding Hand Toolkit utilizes several elongated lug-tools arranged on one or both ends of the handle. The simplest and most common format of the Folding Hand Toolkit assembly is for the series of elongated lug-tools on each side of the handle to be equipped with a center hole. The center hole will align with corresponding holes in the handle in which a shaft will connect, support and allow pivoting of each elongated lug-tool. With this arrangement of elongated lug-tool components, the elongated lug-tool can pivot freely within the confines of the handle.

A further embodiment of the present invention is that the working end of the elongated tools and the lug aft end of the elongated lug-tool are manufactured and produced to their basic form, function, size and shape separately from one another. In producing an elongated lug-tool in this fashion it does not complicate the parameters required to produce a properly functioning elongated tool working end or complicate the parameters required to produce a properly functioning aft end lug section of an elongated tool.

A further embodiment of the present invention is that the lug portion offers additional flexibility when designing elongated lug-tools as opposed to elongated tools. Some examples of this are: (1) an elongated lug-tool can be designed with parallel walls of similar dimensions to that of an adjacent elongated lug-tool of dissimilar size and/or function so that each elongated lug-tool when assembled inline along a common axis is supported within a handle that in turn supports the elongated lug-tool assembly. This can minimize or eliminate the need of using washers or other supportive components for maintaining the alignment of the elongated lug-tool: (2) a grouping of lugs can be designed to accommodate a disparate of lugs that can use a common handle. When these new design considerations are given to the previous example describing the dimensional differences between metric and fractional hex keys the differences in width of each elongated tool can be balanced with the addition or subtraction of material used for the lug section of an elongated lug-tool. It is possible that the combination of widths of each lug when comparing metric and fractional hex key sets can be made equal. This would then allow a common handle to be used for both Folding Hand Toolkits: (3) When design considerations are given to the diameter of a looped base that forms the aft end tail section of an elongated tool that is made of round stock, it is noted that the offsetting leverage when a torsion load is applied to the working end of an elongated tool it is proportional to the inside diameter of the looped tool plus two times the radius of the stock from which an elongated tool is made. When an elongated tool is made from hex stock the offsetting leverage is proportional to the inside diameter of the looped tool plus two of the six side widths. When round or hexagonal shaped shafts of elongated tools are placed next to one another the proportional balance in regards to leverage is often offset to the detriment of an adjacent elongated tool. In all cases when traditional elongated tools are configured the maximum strength can only be realized when a spacer or washer is used betwixt dissimilar elongated tool stock dimensions when the elongated tools are mounted next to one another. When using elongated lug-tools aligned next to each other, the aft ends can be designed to have the same dimensions for all mating surfaces regardless of the stock from which the extended tool is made. Additional strength to offset leverage when a torsion load is applied to the working end of an elongated lug-tool can easily be designed into the lug section by increasing the radial dimension of the lug portion without having to change dimensions of the extended tool section of an elongated lug-tool.

A further embodiment of the present invention is that almost any conceivable type of extended tool of reasonable size can be amalgamated with lugs. Some of these extended tools are, but are not limited to, a screwdrivers, hex wrenches, box wrenches, hex key, Torx® drivers, files, saw blades, nut drivers, drive sockets and tap and die sets. Many types of these mentioned extended tools previously could not be made into Folding Hand Toolkits but can now be amalgamated with lugs to form elongated lug-tools.

A further embodiment of the present invention is the inherent design flexibility in devising a means to producing a locking mechanism that would allow a hobbyist or tradesmen to securely position an elongated lug-tool for use. Heretofore it was impractical to incorporate some tools into a Folding Hand Toolkit because the methods of producing Folding Hand Toolkits using the looping process limited the ability of hand tool designers to design a secure mechanism for locking an elongated tool with the handle for use. Some of the elongated tools that have been listed and previously could not be used in a Folding Hand Toolkit because the handle could not lock the elongated tool in position are hex wrenches, files and cutting tools. This invention allows a hand tool designer to produce surfaces in the aft end of elongated lug-tools that can mate with adjacent elongated lug-tools and in turn mate with the handle of the Folding Hand Toolkit. It is conceivable that every surface of the lug section of an elongated lug-tool can be modified to incorporate features of locking mechanisms. These surfaces include the inside core of the lug, the outside surfaces that extend radial from the center core of the lug and the side walls of the lug. These lug surfaces combined with locking components such as a pin, spline, lever, wedge, cam, screw, catch or hook can produce viable means to lock an elongated lug-tool securely in place for use.

A further embodiment of the present invention is the inherent design flexibility in devising a means to producing a detent locking mechanism that would allow a hobbyist or tradesmen to position an elongated lug-tool in a semi-secure or saddled position for use. This invention allows a hand tool designer to produce surfaces in the aft end of elongated lug-tools that can mate with adjacent elongated lug-tools and in turn mate with the handle of the Folding Hand Toolkit. It is conceivable that every surface of the lug section of an elongated lug-tool can be modified to incorporate features of detent locking mechanisms. These surfaces include the inside core of the lug, the outside surfaces that extend in a radial direction from the center core of the lug and the side walls of the lug. These lug surfaces can be designed and equipped with detents that can produce semi-secured positioning of an elongated lug-tool. A detent can take the form of dimple, wave, grove or any other shape that can mate with a similar shape on an opposing surface of another elongated lug-tool and then in turn mate with a similar shape on the handle of the Folding Hand Toolkit. The mating detent surfaces can be in a slight compressive state when being positioned with the compressive state being somewhat relieved once positioned so as the force required to position an elongated lug-tool be easily within the range the tool operators capabilities.

BRIEF DESCRIPTION OF THE DRAWINGS

For better understanding of the present invention, reference is to be made to the accompanying drawings. It is to be understood that the present invention is not limited to the precise arrangement shown in the drawings.

DETAILED DESCRIPTION OF THE PREFERRED EMBODIMENTS

Figure 1:
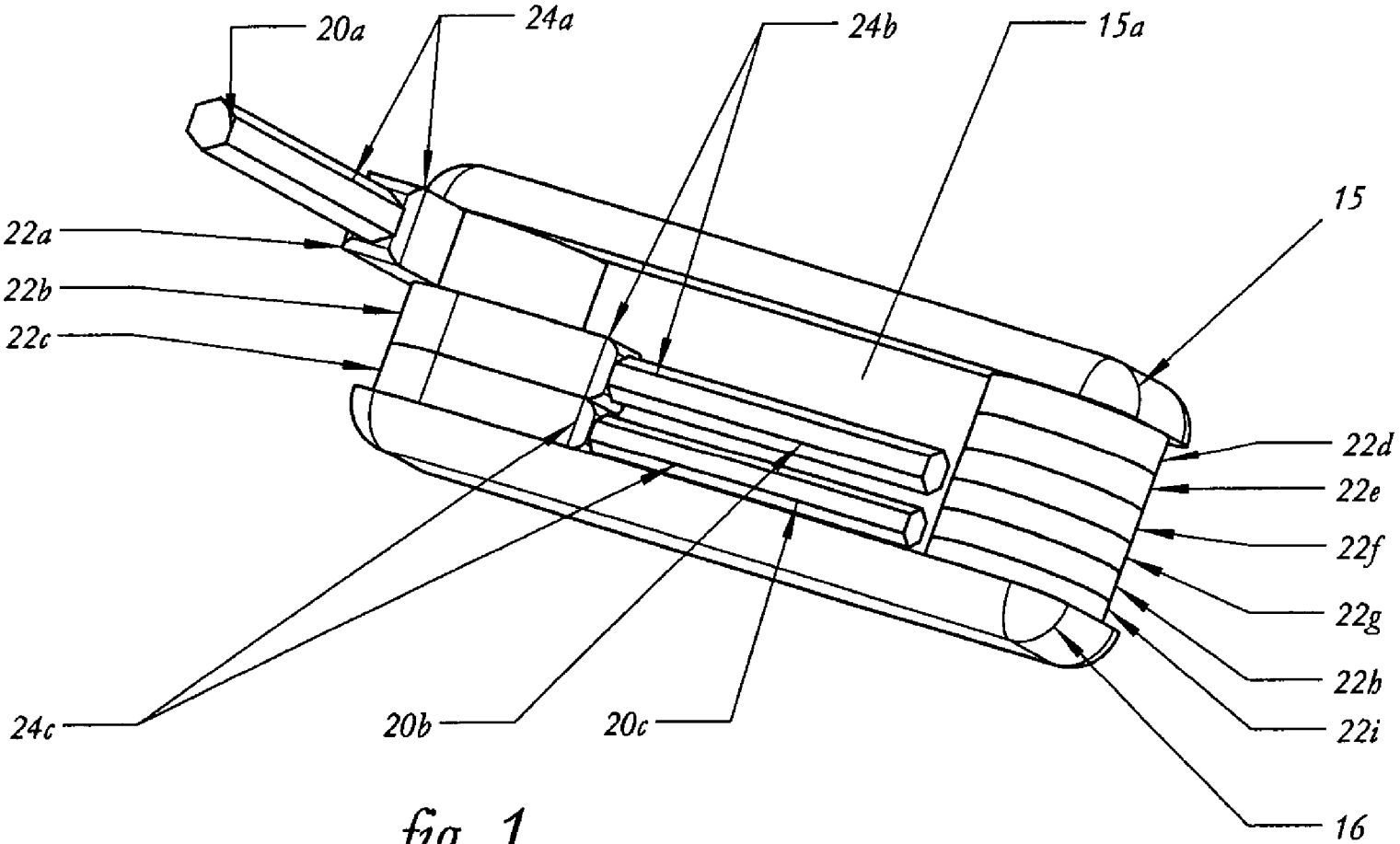
FIG. 1 is an isometric view of a typical Folding Hand Toolkit which embodies elongated lug-tool of the subject of this invention.

FIG. 1 is an isometric view of a Folding Hand Toolkit instrument in which embodies elongated lug-tools 24*a* to 24*i* are contained within handle side sections 15 and 16. The web sections of the handle 15*a* and 16*a* determine the spacing between the handle sides, are integral to the handle and are formed 90 degrees to handle side sections 15 and 16. Elongated lug-tool 24*a* is an amalgamated assembly of the elongated tool 20*a* and the lug 22*a*, as is elongated lug-tool 24*b* an amalgamated assembly of the elongated tool 20*b* and the lug 22*b* and so on with elongated lug-tool 24*c* through 24*i* are amalgamated assemblies incorporating elongated tools 20*c* through 20*i* with the associated lugs 22*c* through 22*i*.

Figure 2:
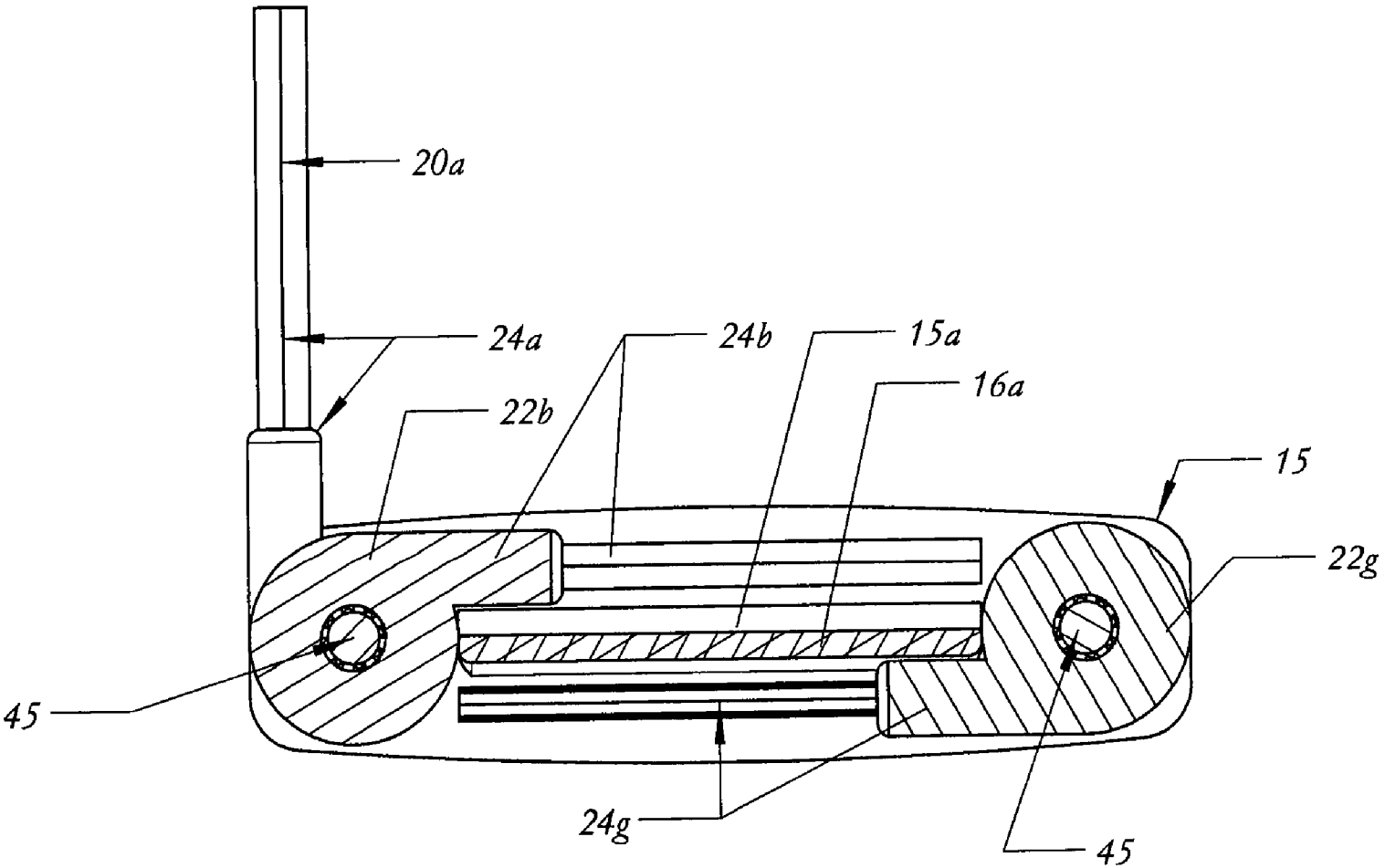
FIG. 2 is a cross section view which embodies elongated lug-tool of the subject of this invention.

Elongated lug-tools 24*a* to 24*i* are held in place and allowed to rotate by shafts 45 as shown in the cross sectional view of FIG. 2. Elongated lug-tools 24*b* to 24*i* are shown in the closed position for storage elongated lug-tools 24*a* is situated in one of many extended positions for use. The diameters of the lug sections 22*a* through 22*i* are shown to be of the same outside diameter or substantially similar diameter and able to accommodate the extended tool sections 20*a* through 20*i* that are of varying sizes. The substantially similar diameter provides a substantially uniform bearing surface for receiving forces transmitted by the lug-tool during use. The widths of the lug sections 22*a* through 22*i* vary as required for the varying extended tool sections 20*a* through 20*i*.

The handle 15 and 16 are shown as a two piece assembly. Folding Hand Toolkit instruments utilizing elongated lug-tools can be incorporated into the confines of a one-piece handle or two or more piece handle. For purpose of illustration the elongated lug-tools shown in FIG. 1 and FIG. 2 are hex keys however it is understood that other elongated tools such as screwdrivers, hex wrenches, box wrenches, hex key, Torx® drivers, files, saw blades, nut drivers, drive sockets, tap and die sets may be used in similar fashion.

Figure 3:
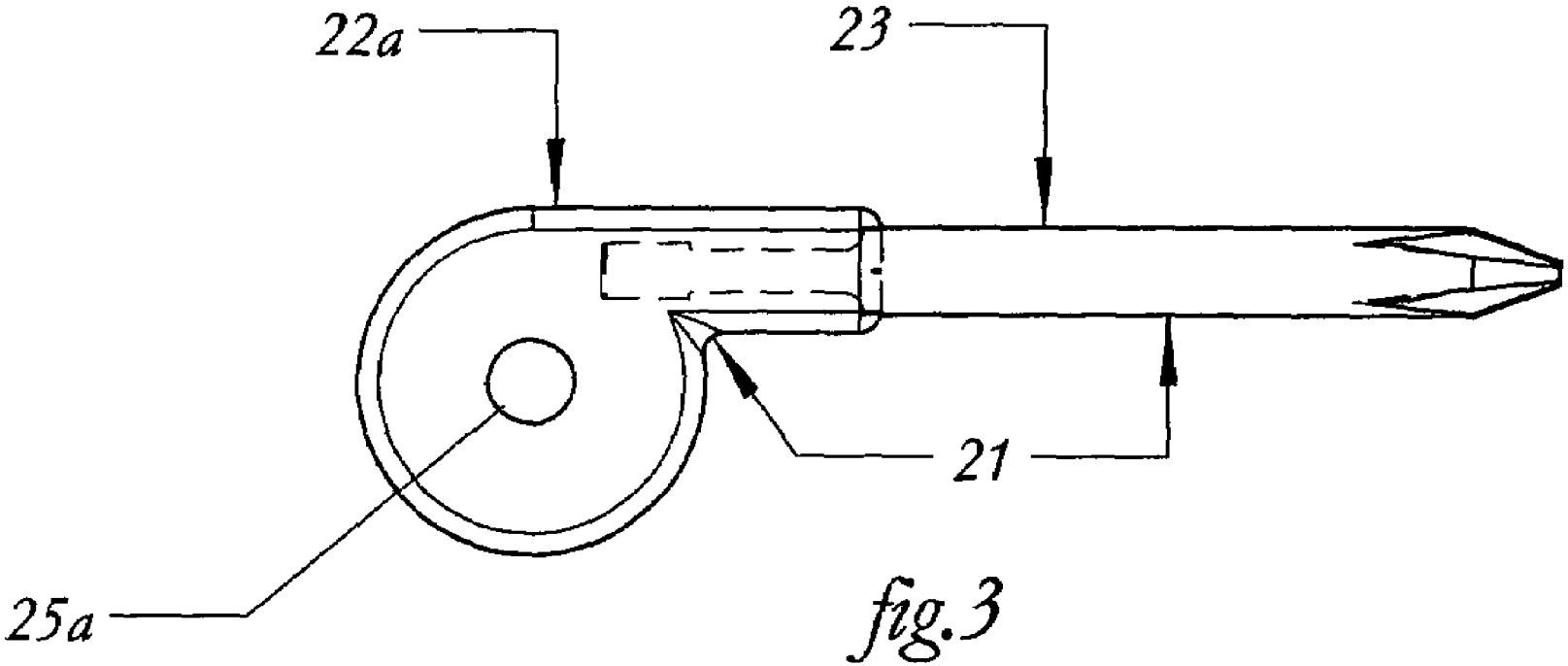
FIG. 3 is of a smooth surface lug that has been amalgamated with a Philips driver elongated tool.

The elongated lug-tool 21 in FIG. 3 depicts a lug 22*a* and Philips driver 23 that are manufactured to form an amalgamated Philips elongated lug-tool 21. The smooth exterior contour surfaces of the lug 22*a* or the interior center mounting hole 25*a* pose no interference with any other. components other than the web sections 15*a* and 16*a* when placed in a closed position or an over extended open position. This is an example of how an elongated lug-tool can be produced to perform the same tasks of traditional elongated tools.

Figure 4:
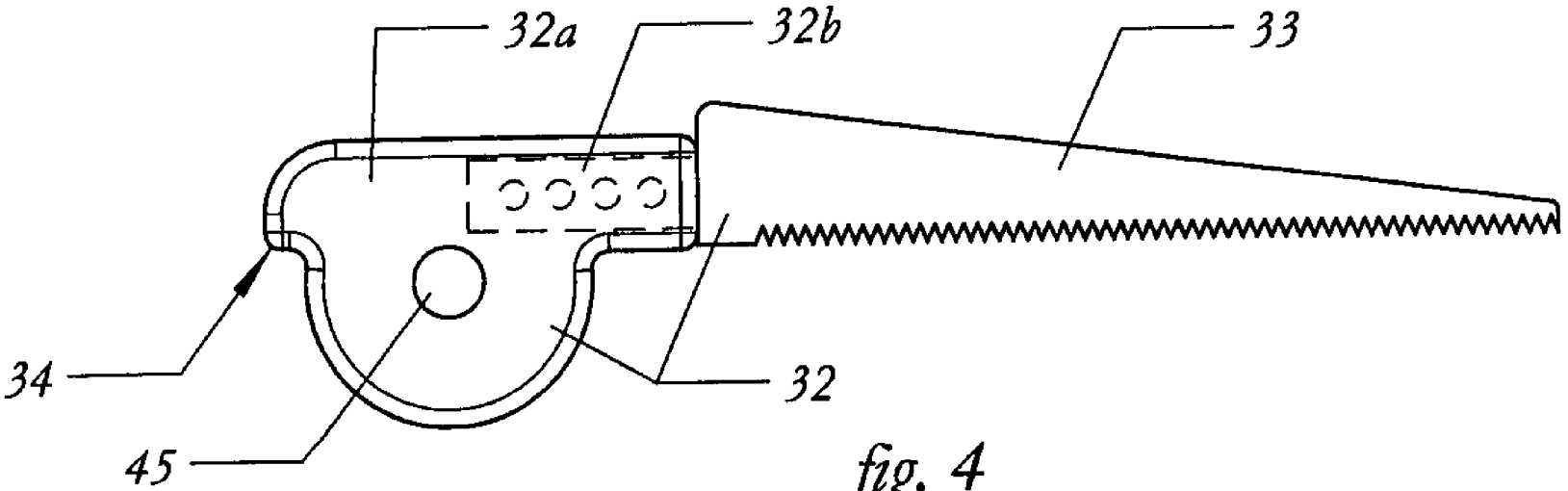
FIG. 4 is of a lug with the outside surface that is designed to extend in a radial direction and amalgamated with an extended saw blade.

The elongated lug-tool 32 shown in FIG. 4 is a lug 32*a* featuring an external stop 34. The lug 32*a* has been fitted with a saw to form an amalgamated saw elongated lug-tool 32. When this type of cutting tool is selected for use the lug-tool 32 is pivoted around the center shaft 45 until the external stop feature 34 mates with the web sections 15*a* or 16*a* (shown in FIG. 2) so that when force is applied opposite the teeth of the saw, the saw blade 33 will be supported by the web sections. This is only one example of how the outside radial surface of a lug can be modified to produce a beneficial locking surface.

Figure 5:
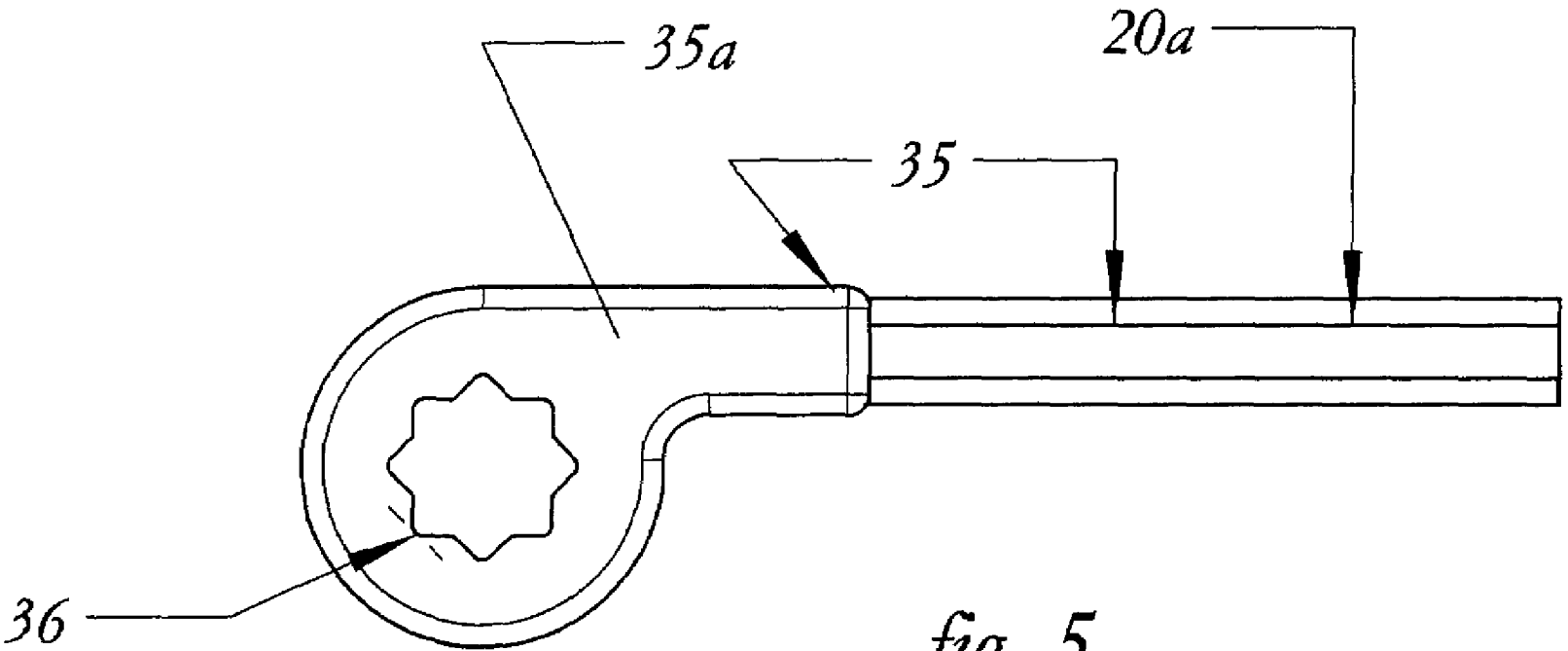
FIG. 5 is of a lug that had the center hole modified and amalgamated with a hex key.

FIG. 5 is a lug 35*a* equipped with a hex key 20*a* and assembled to form an amalgamated hex key elongated lug-tool 35. An additional feature shown in FIG. 5 is that the center mounting hole 36 has been designed to form a multi faceted shape that when a center shaft is fixed stationary relative to the handles 15 and 16 and the multi faceted center shaft has similar dimensions and features that mate with this multi faceted center hole 36 the elongated lug-tool will be also held in a fixed position, not allowing it to rotate. This is only one example of how the center mounting hole of a lug can be designed to produce components for locking an elongated lug tool in place for use.

Figure 6:
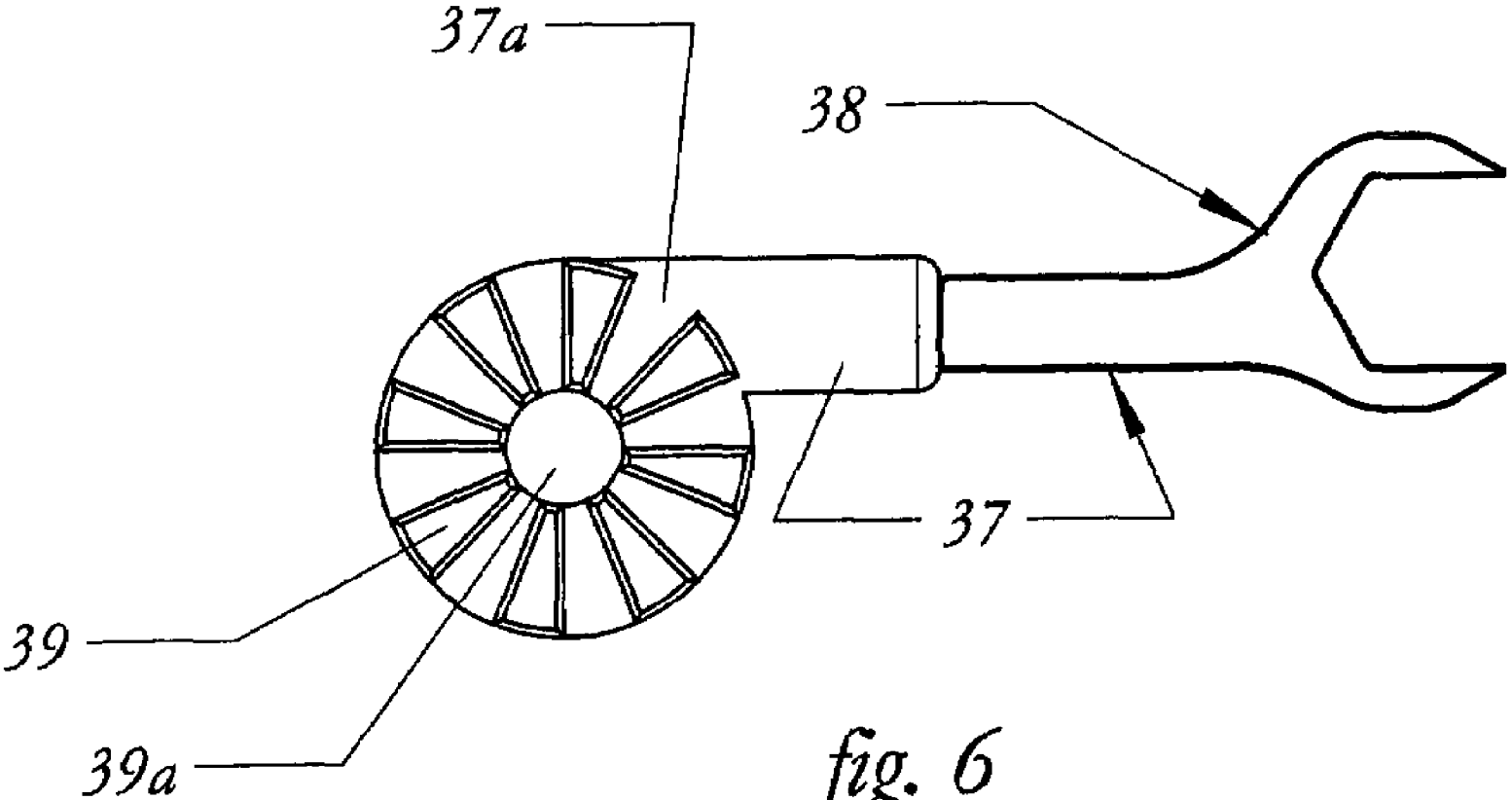
FIG. 6 is of a lug that features raised and/or relief sidewall surfaces and amalgamated with a hex wrench.

FIG. 6 displays a lug 37*a* that has been assembled with a hex wrench 38 to form an amalgamated hex wrench elongated lug-tool 37. It is shown that the lug 37*a* has geometry 39 on the sidewalls of the lug. This geometry 39 has a raised surface, a relief surface or a combined raised and relief surface that is designed to mate with an adjacent lug of equal proportions that is equipped with a mating raised and/or relief surface that once positioned will engage when placed together. Additional mating surfaces are located on a handle section so that depending on the design of the mechanism the lugs will engage and lock in place or the lugs will engage and be saddled in place using a detent method with the handle in the handle section of the Folding Hand Toolkit. Raised and relief surfaces designed into the side wall of the lug can be of any geometric shape as long as they have mating shapes in adjacent lugs and handle sections to engage with. This is only one example of how the sidewalls of a lug can be designed to produce components for locking an elongated lug tool in place for use.

Figure 7:
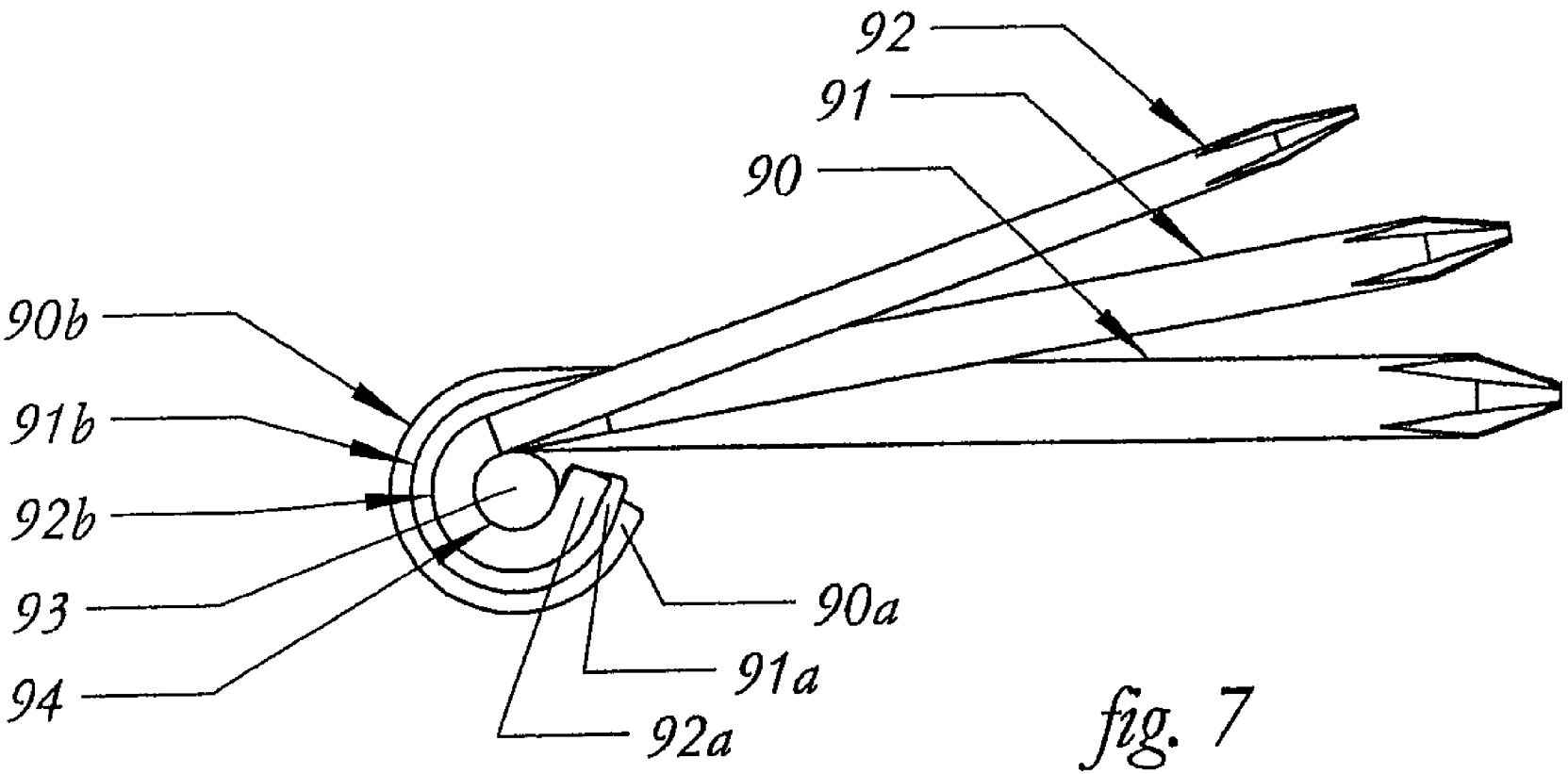
fig. 7 (Prior Art)
FIG. 7 is a view of a set of three traditionally formed looped extended Philips driver tools.

In FIG. 7 three traditional style elongated tools 90, 91 and 92 are aligned in descending order according to size. They are secured and allowed to pivot on a common center shaft 93 as illustrated. Looped end tail sections 90*a*, 91*a* and 92*a* are unsupported and show an incomplete encompassing of the center shaft 93. Each of the traditional style elongated tools 90, 91 and 92 have been looped to common inside diameter 94 that allows the elongated tools to be retained but free to pivot around the common center shaft 93. When any of the elongated tools are utilized, offset torque load forces are experienced from one elongated tool to the next and exaggerated due to unequal leverage of dissimilar mating surfaces as a result of the different outside diameters 90*b*, 91*b* and 92*b* that each of traditional elongated tools provide.

Figure 8:
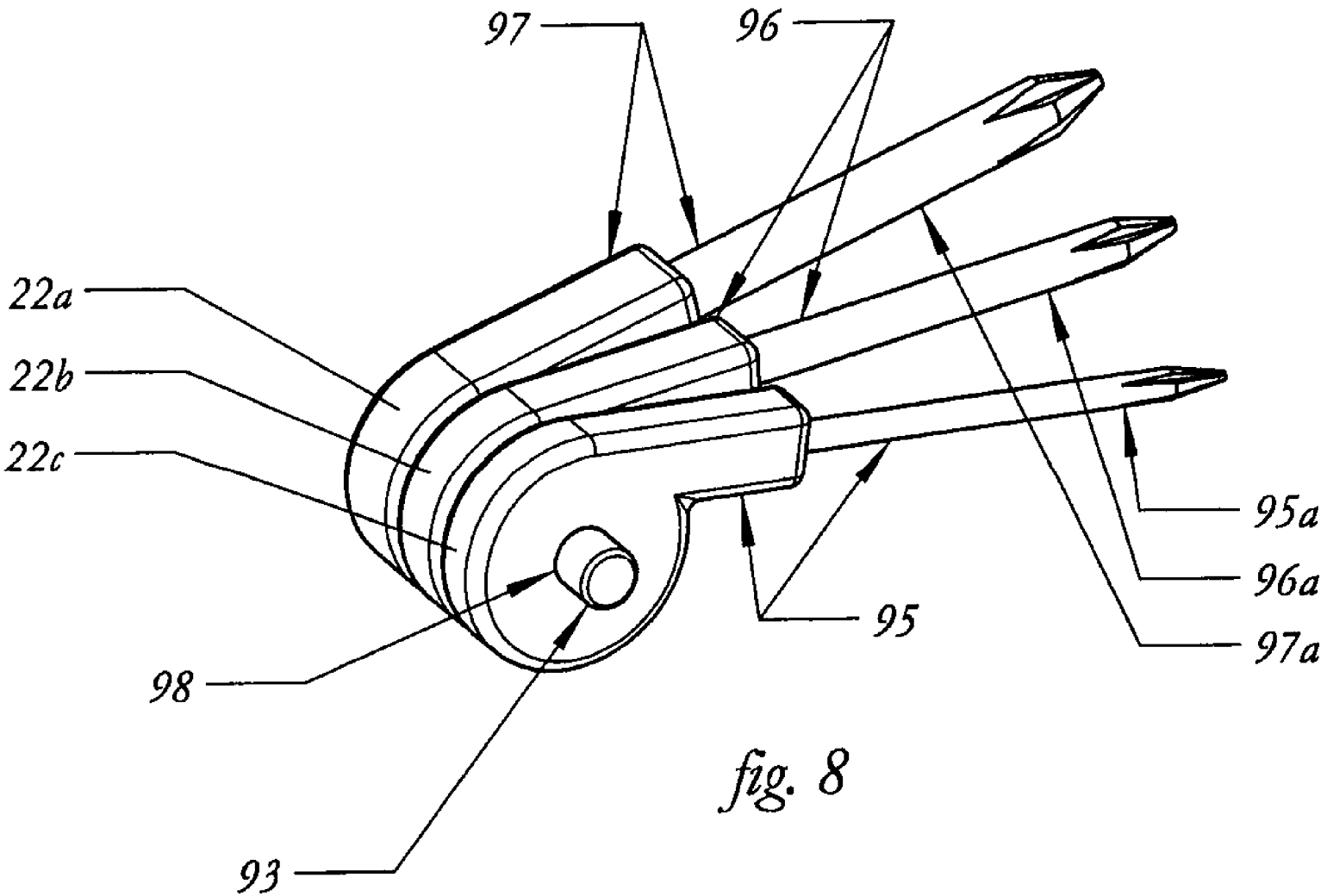
FIG. 8 is a view of a set of three lug-tools amalgamated extended Philips driver tools.

In FIG. 8 three lug style elongated lug-tools 95, 96 and 97 are aligned in descending order according to size. They are secured and allowed to pivot on a common center shaft 93 as illustrated. Each lug 22*a*, 22*b* and 22*c* are mated with a Philips drivers 95*a*, 96*a* and 97*a* respectively. The elongated tools are assembled with the lugs to form the amalgamated Philips elongated lug-tools. Each elongated lug-tools is situated adjacent to the next along the axis of the shaft 93. Each of the elongated lug-tools 95, 96 and 97 have a common inside diameter 98 that allows the elongated tools to be retained but free to pivot around the common center shaft 93. Each of the lugs 22*a*, 22*b* and 22*c* are of common sidewall dimensions. When any of the elongated lug-tools are utilized, offset torque load forces are experienced from one elongated tool to the next and equal leverage of similar mating surfaces are realized as a result of the similar outside diameters of the lugs 22*a*, 22*b* and 22*c* that each of the elongated lug-tools provide.

Figure 9:
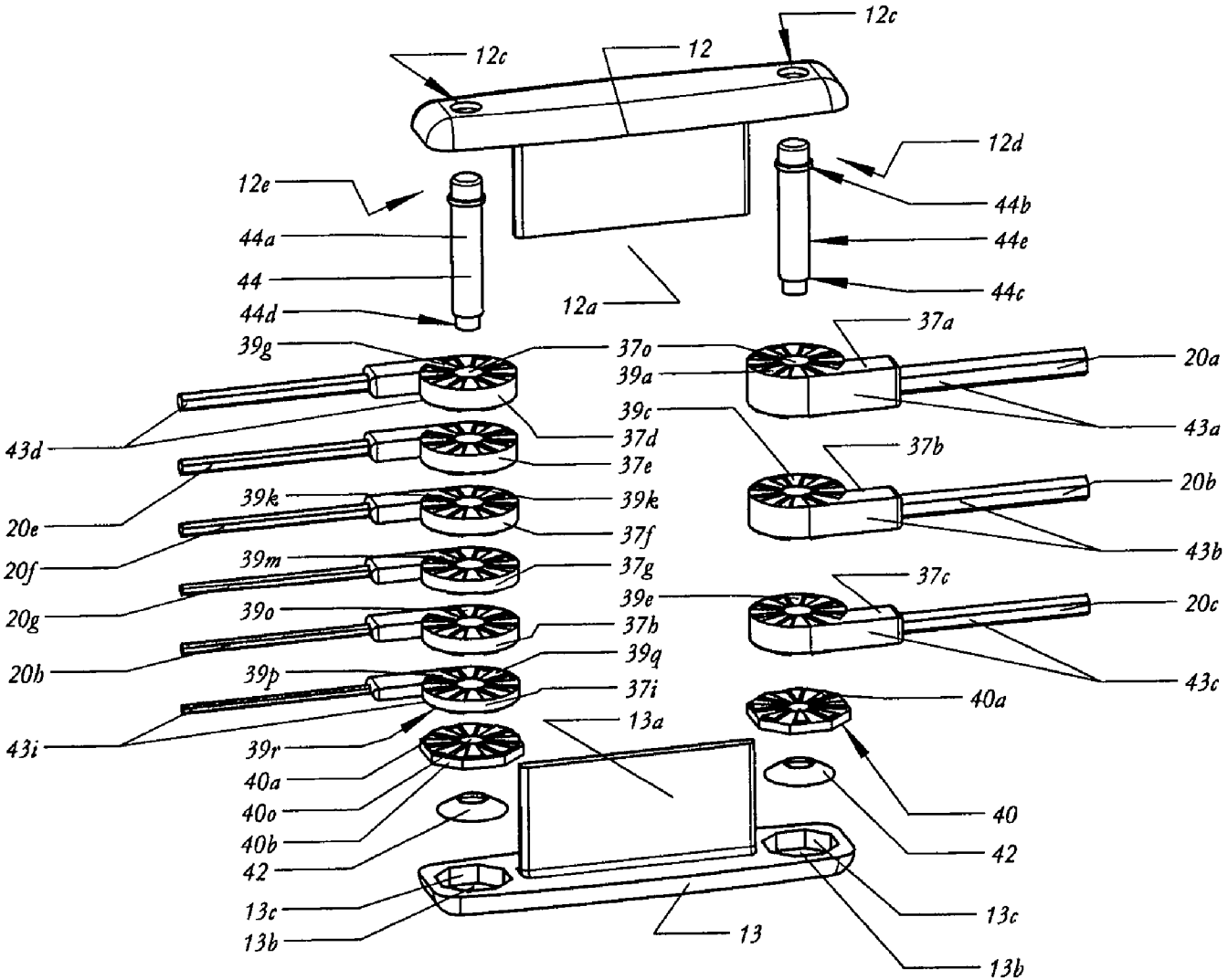
FIG. 9 is a detailed exploded view of a Folding Hand Toolkit instrument with a sidewall lug locking mechanism that utilizes a pushbutton.

In FIG. 9 this exploded isometric view is an example of a locking mechanism that utilizes the sidewalls of the lugs 37*a* through 37*i*, handle sections 12 and 13 and floating plates 40 to create the locking device that locks each component between each adjacent component when placed under compression with the use of compression springs 42. It is shown that each lug has geometry on each of the sidewalls 39*a* through 39*r* of the lugs 37*a* through 37*i*. This geometry has a contoured surface, raised surface, a relief surface or a combined raised and relief surface that is designed to mate with the adjacent lug of equal proportions that is also equipped with a mating raised and/or relief surface forming opposing mating surfaces on the parallel sidewalls. The raised and relief surface may be angled slightly to form a cam, cam surface, or cam action. The cam surface upon rotation causes axial displacement of one of the plastic lugs disengaging a contoured surface and an adjacent complementary or mating contoured surface permitting the elongated tool to be angularly positioned relative to the handle. Once positioned and pressed together the mating surfaces of each lug will engage with an adjacent lug. Each lug 37*a*, 37*b* and 37*c* are located on one side of the handles and lugs 37*d* through 37*i* are located on the opposite side of handles 12 and 13. All lugs are equipped with similar mating surfaces to that on the handle mating surfaces 12*d* and 12*e* and the floating plate 40 mating surfaces 40*a*. When the mating surface handle 12*d* or 12*e* is pressed against an extended lug tool with a similar mating surface it will engage and lock the lug-tool from rotating to another position. When stacked, the mating surfaces of all lugs will engage directly and indirectly with the handle and floating plate so as not to rotate.

Floating plates 40 are of a polygon shape and each are equipped with similar mating surfaces 40*a* that when pressed together will engage with the adjacent lugs 37*a*, 37*b* and 37*c* on one side of the handle and 37*d* through 37*i* on the opposite side of the handle. The side walls 40*b* of the floating plates 40 can slide in a linear fashion along the axis of the push buttons 44 and within the confines of the similar polygon shaped holes 13*b* of handle section 13. The sidewalls 13*c* of the polygon holes 13*b*, are parallel to the sidewalls 40*b* when assembled with the floating plates 40. The polygon shape of the floating plates 40 situated within the confines of the polygon shaped holes 13*b* prevent the floating plates 40 from rotating. Compression springs 42 are shown to be Belleville Spring Washers although other compression spring types can be used. When the Folding hand tool kit is assembled the compression springs 42 are placed into the polygon holes 13*b*. Floating plates 40 are placed over the compression springs 42 and into the confines of the polygon holes 13*b*. Extended lug-tools 43*a*, 43*b* and 43*c* are placed over floating plate 40 and an extended push button 44 is inserted into the holes 37*o* that are located in the center of each lug and bottoms out with shoulder 44*c* resting on the surface 40*a* of the floating plate 40 with the extended shaft 44*d* projecting through the hole 40*o* located in the center of the floating plate 40. Extended lug-tools 43*d* through 43*i* are placed over floating plate 40 and an extended push button 44 is inserted into the holes 37*o* that are located in the center of each lug and bottoms out with shoulder 44*c* resting on the surface 40*a* of the floating plate 40 with the extended shaft 44*d* projecting through the hole 40*o* located in the center of the floating plate 40. Handle section 12 is situated over the two stacks of extended lug-tools and fitted with the push button extensions 44*a* extending through the handle holes 12*c*. When all components are sandwiched together a press fit of handle web sections 12*a* and 13*a* are made and hold all components in place. Although other methods of holding handle web sections 12*a* and 13*a* can be employed.

Figure 10:
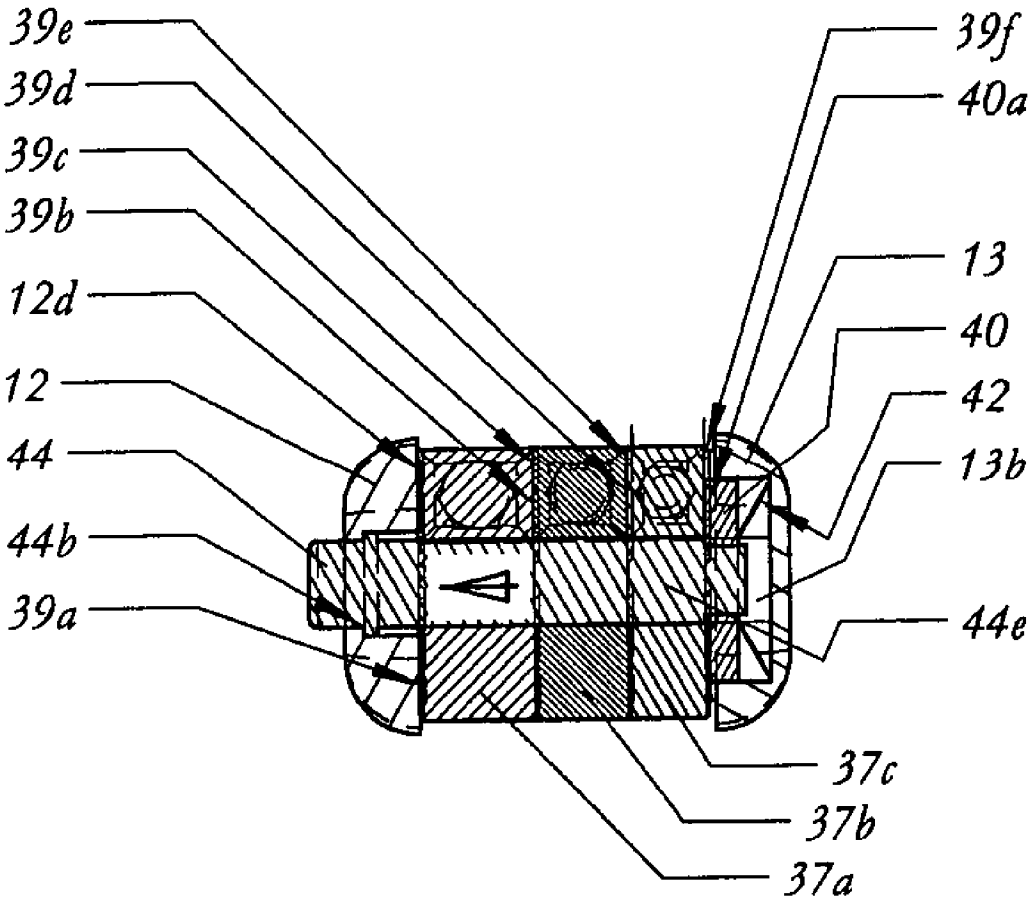
FIG. 10 is a sectional view of a Folding Hand Toolkit instrument with a sidewall lug locking mechanism in its locked position and that utilizes a pushbutton.

When all components are sandwiched together as shown in FIG. 10 and all mating surfaces of the lugs, handle and floating plates are aligned with one another and the push button is in its full extended position than all of the extended lug-tools are locked in place.

Figure 11:
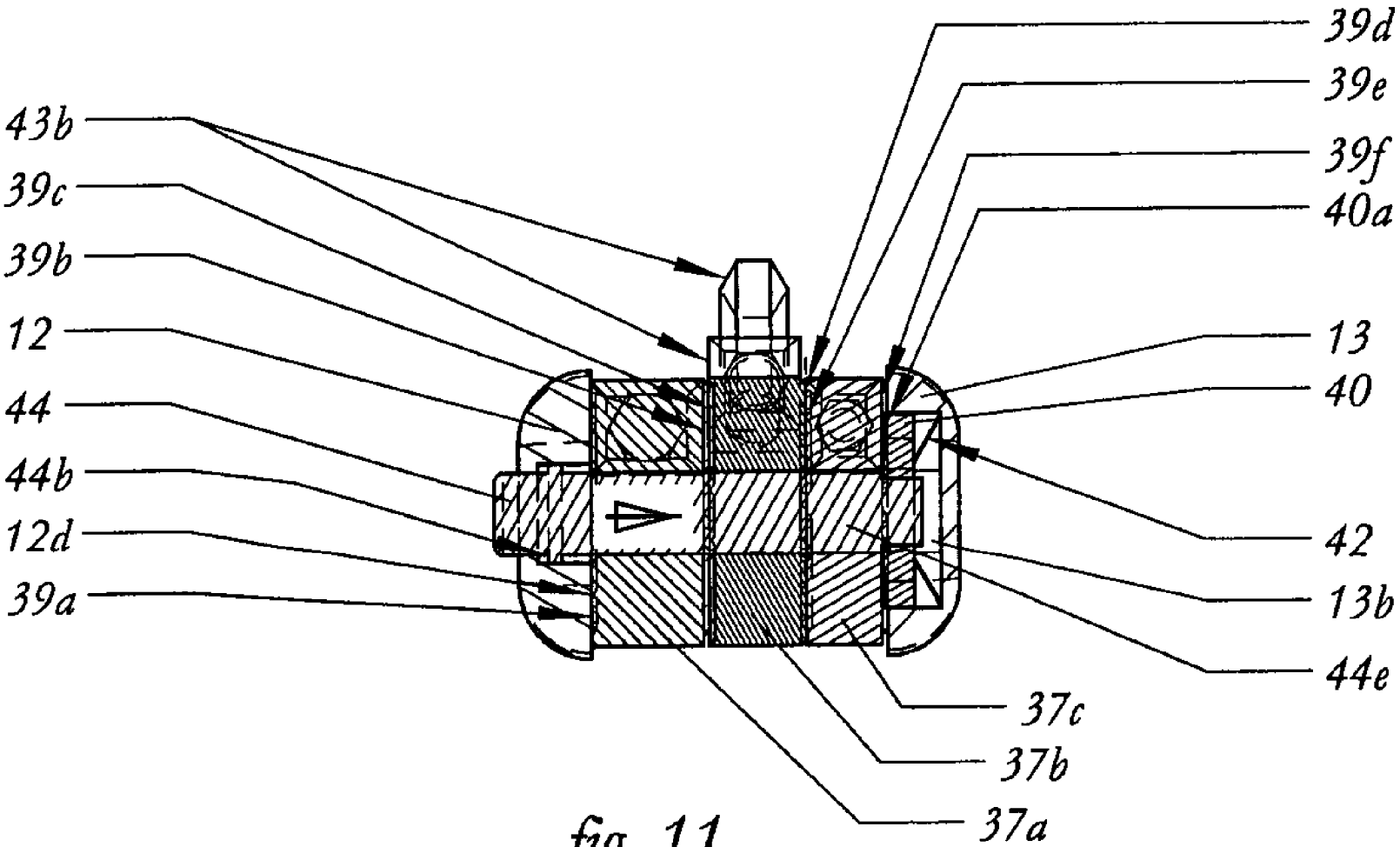
FIG. 11 is a sectional view of a Folding Hand Toolkit instrument with a sidewall lug locking mechanism in its unlocked position and that utilizes a pushbutton.

When a push button 44 is pressed as shown in FIG. 11 the extended push button shaft 44*e* travels in a linear direction through the center holes 37*o* and forces the push button shoulder 44*c* to press against surface 40*a* of the floating plates 40 and in turn compress the compression spring 42. The stroke length that the push button can travel and depress the floating plate 40 and compression spring 42 determines how much space between the sidewall surfaces of any given lug and an adjacent lug, a sidewall surface of a lug and the mating handle surface and a sidewall surface of a lug and the mating floating plate surface will be provided. The space provided must be greater than the depth of the geometry of the raised surface, relief surface or a combined raised and relief surfaces in order to be able to position an extended lug-tool.

Figure 18:
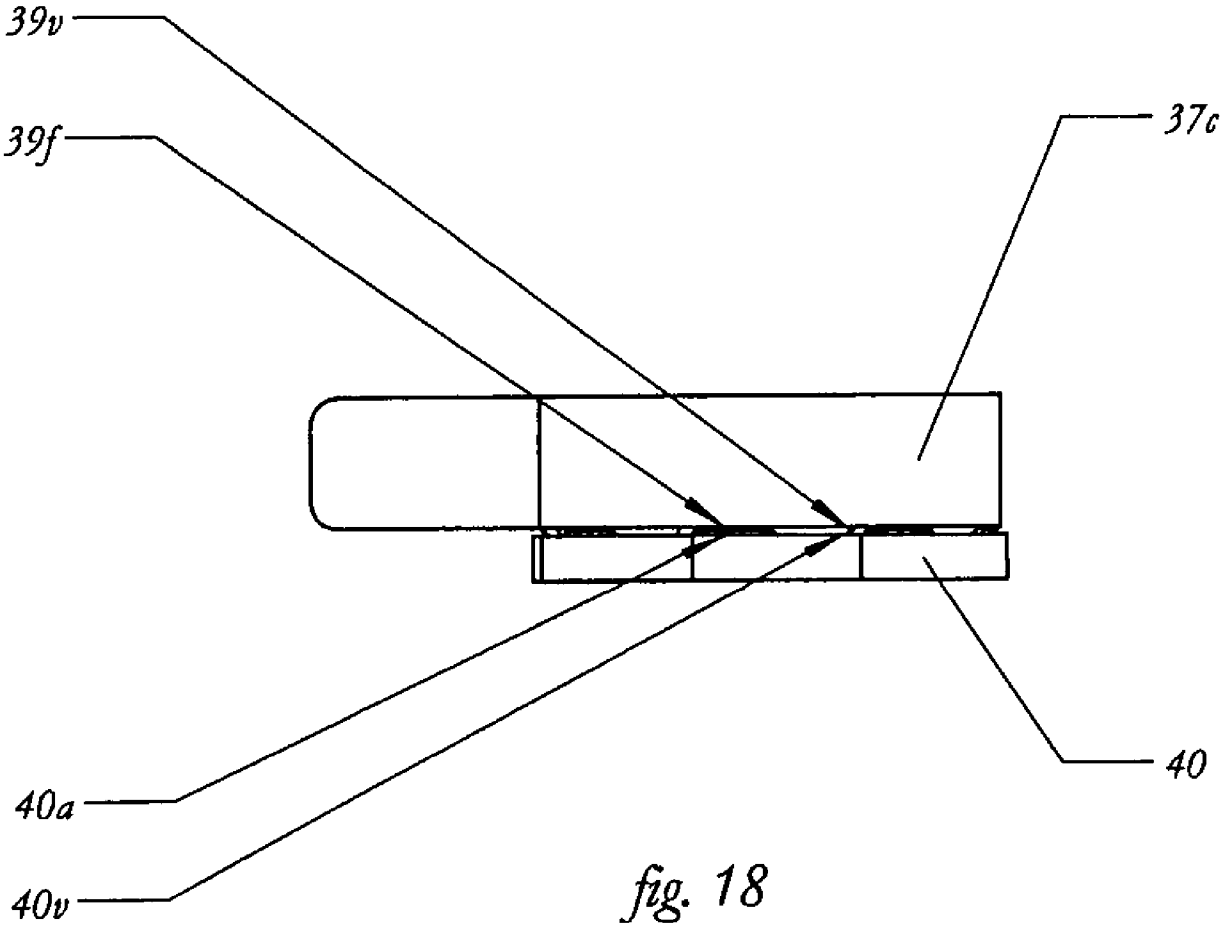
FIG. 18 is an illustration of two components each with sidewall locking features that are situated in an engaged position.
Figure 19:
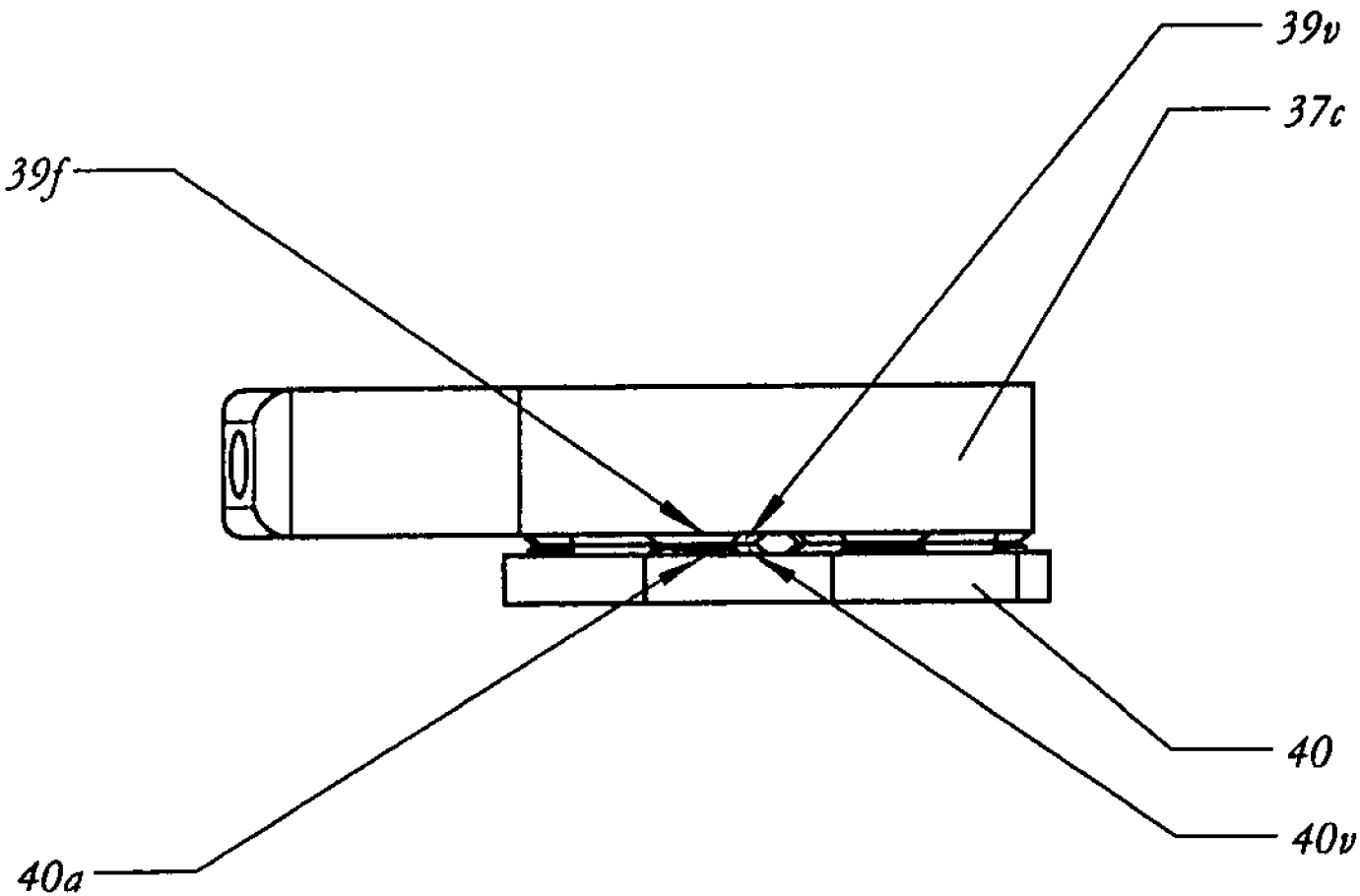
FIG. 19 is an illustration of two components each with sidewall locking features that are situated in an unengaged position.

As shown in FIG. 18 and FIG. 19, sloped side walls 39*v* and 40*v* of the raised and relief surfaces can be provided to more easily facilitate separation of the mating geometries of any given lug tool to the adjacent mating surface.

As shown in FIG. 11, once a push button 44 is pressed, the compression forces are relieved between all locking raised and relief surfaces, the exampled extended lug-tool 43*b* is positioned by rotating the tool around the extended shaft 44*e* of the push button 44. After a lug tool 43*b* has been positioned in either an extended position for use or folded back into the confines of the handle sections for storage the push button 44 can be released as shown in FIG. 10 and the extended lug-tool 43*b* will be locked in place along with all other components with similar mating surfaces and that are placed along the same axis.

Figure 12:
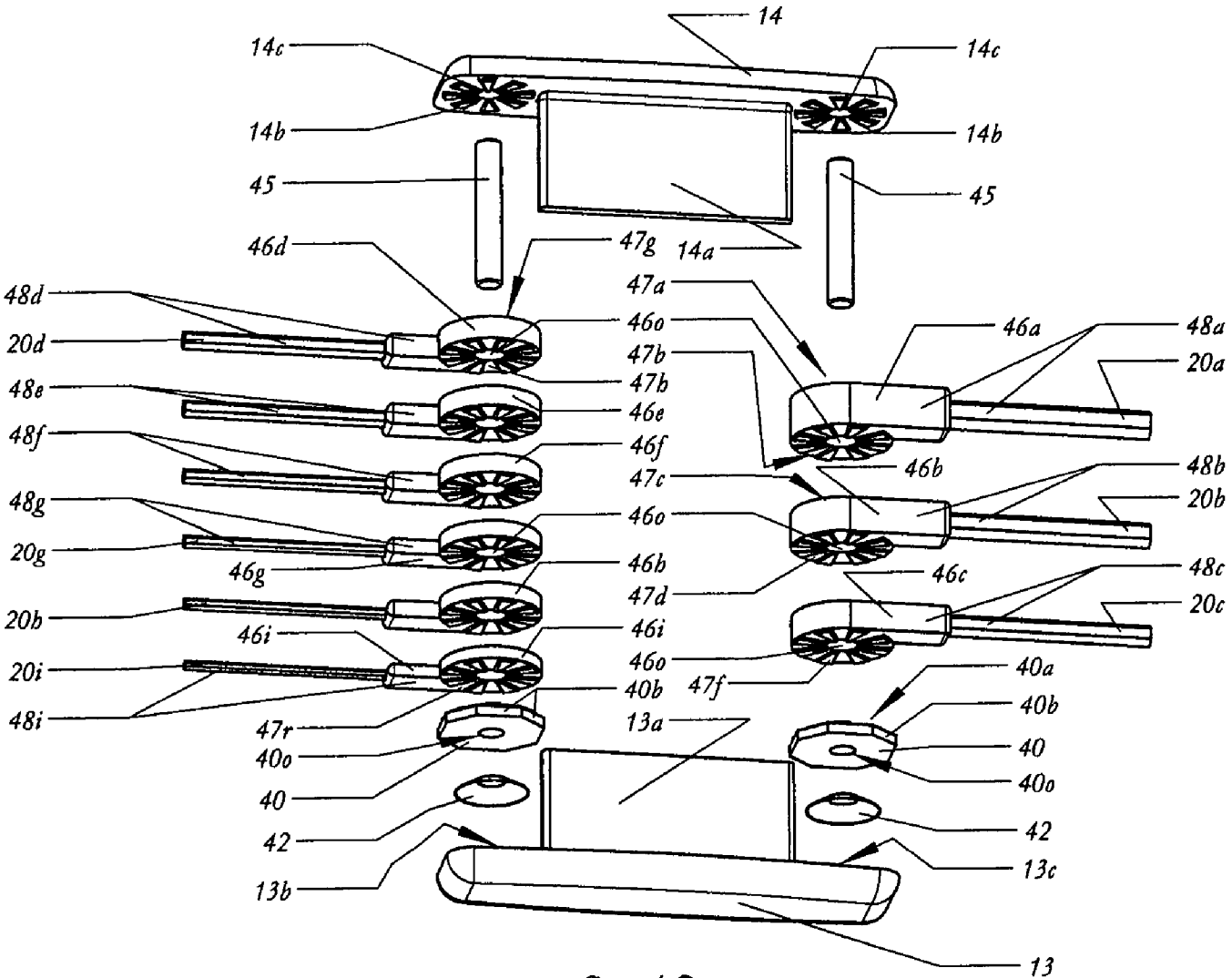
FIG. 12 is a detailed exploded view of a Folding Hand Toolkit instrument with a sidewall lug detent locking mechanism.

FIG. 12 illustrates another embodiment of the present invention. In FIG. 12 this exploded isometric view is an example of a detent locking mechanism that utilizes the sidewalls of the lugs 46*a* through 46*i*, handle sections 13 and 14 and floating plates 40 to create the detent locking device that saddles each component between each adjacent component when placed under compression with the use of compression springs 42. It is shown that each lug 46*a* through 46*i* has geometry on each of the sidewalls 47*a* through 47*r*. This geometry has a raised surface, a relief surface or a combined raised and relief surface that is designed to mate with the adjacent lug of equal proportions and is also equipped with a mating raised and/or relief surface. Once positioned and pressed together the mating surfaces of each lug will engage with an adjacent lug. Each lug 46*a*, 46*b* and 46*c* are located on one side of the handles and lugs 46*d* through 46*i* are located on the opposite side of handles 13 and 14. All lugs are equipped with similar mating surfaces to that on the handle mating surfaces 14*b* and the floating plate mating surfaces 40*a*. When the mating handle surface 14*b* is pressed against an extended lug tool with a similar mating surface it will engage and provide a detent position that will semi-secure the lug-tool from rotating to another position. When stacked and aligned, the mating surfaces of all lugs will engage directly and indirectly with the handle and floating plate so as not to rotate freely.

Floating plates 40 are of a polygon shape and each are equipped with similar sidewall mating surfaces 40*a* that when pressed together will engage with the adjacent lugs 46*a*, 46*b* and 46*c* on one side of the handle and 46*c* through 46*i* on the opposite side of the handle. The sidewalls 40*b* of the floating plates 40 can slide in a linear fashion along the axis of the shafts 45 and within the confines of the similar polygon shaped holes 13*b* of handle section 13. The sidewalls 13*c* of the polygon holes 13*b* are parallel when assembled with the sidewalls 40*b* of the floating plates 40. The polygon shape of the floating plates 40 situated within the confines of the polygon shaped holes 13*b* prevent the floating plates 40 from rotating. Compression springs 42 are shown to be Belleville Spring Washers although other compression spring types can be used. When the Folding hand tool kit is assembled the compression springs 42 are placed into the polygon holes 13*b*. Floating plates 40 are placed over the compression springs 42 and into the confines of the polygon holes 13*b*. Extended lug-tools 48*a*, 48*b* and 48*c* are placed over floating plate 40 and the shaft 45 is inserted into the holes 46*o* that are located in the center of each lug and through hole 40*o* of the floating plate 40. Extended lug-tools 48*d* through 43*i* are placed over floating plate 40 and the shaft 45 is inserted into the holes 46*o* that are located in the center of each lug and through holes 40*o* of the floating plate 40. Handle section 14 is situated over the two stacks of extended lug-tools, 48*c*, 48*e*,

48*f*, 48*i* and 48*a*, 48*b*, 48*c* and fitted with the shafts 45 extending into the handle holes 14*c*. When all components are sandwiched together a press fit of handle web sections 14*a* and 13*a* are made and hold all components under compression and in place. Although other methods of holding handle web sections 14*a* and 13*a* can be employed.

Figure 13:
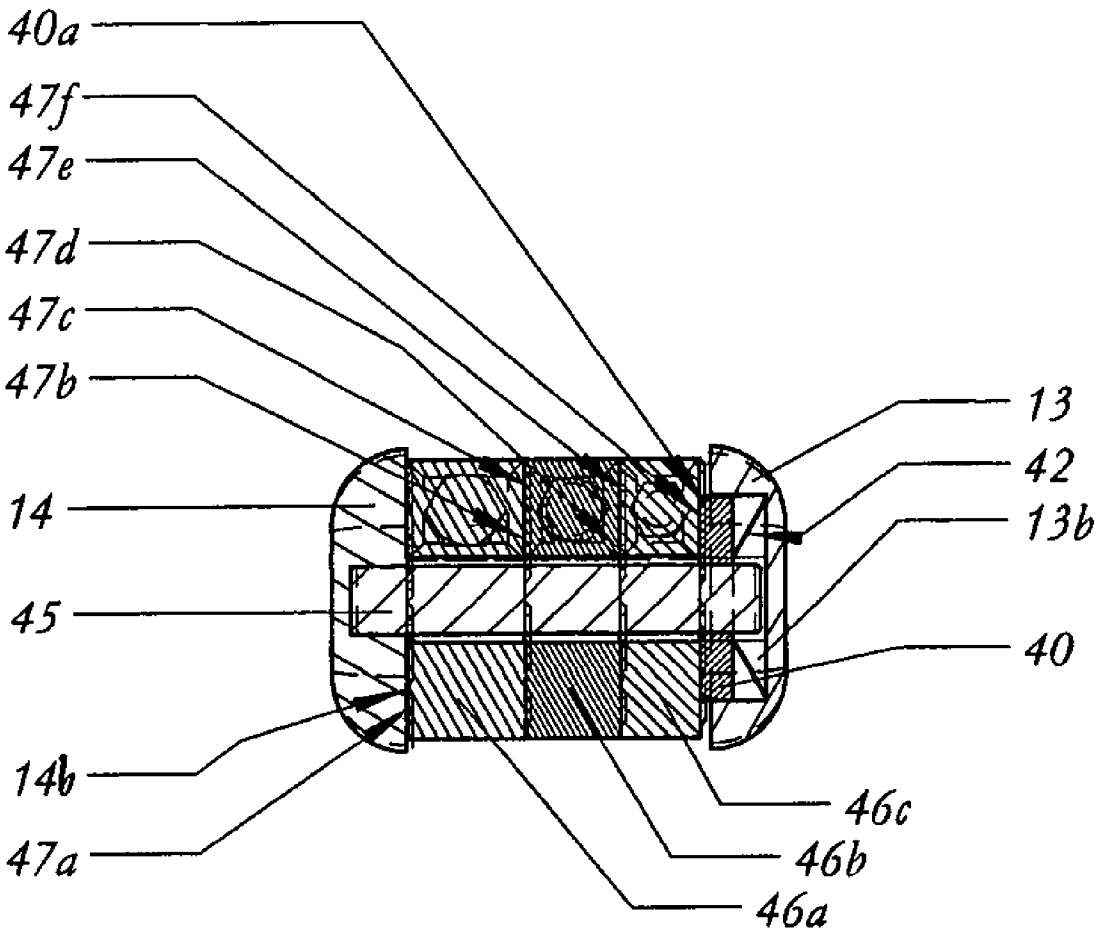
FIG. 13 is a sectional view of a Folding Hand Toolkit instrument with a sidewall lug detent locking mechanism in its locked position.

When all components are sandwiched together as shown in FIG. 13 and all mating surfaces of the lugs, handle and shafts are aligned with one another then all of the extended lug-tools are semi-secured in place. The geometry that make up the surface that is on each sidewall 47*a* through 47*r* of each lug 46*a* through 46*i*, the surfaces 14*b* on the handle 14 and the surfaces 40*a* on the floating plates 40 have a raised surface, a relief surface or a combined raised and relief surface that is designed to mate with the adjacent lug of equal proportions and is also equipped with a mating raised and/or relief surface.

Illustrated as an example in FIG. 18 and FIG. 19 the sidewalls 39*f* and 40*a* have sidewalls with raised or relief surfaces that have a slope 39*v* and 40*v* to their geometry. This slope provides the mechanical advantage of an incline plane. When an elongated lug-tool is selected to be positioned for use or stored in its home position an operator will pivot the elongated lug-tool around the stationary shaft 45, illustrated in FIGS. 12 and 13.

Figure 14:
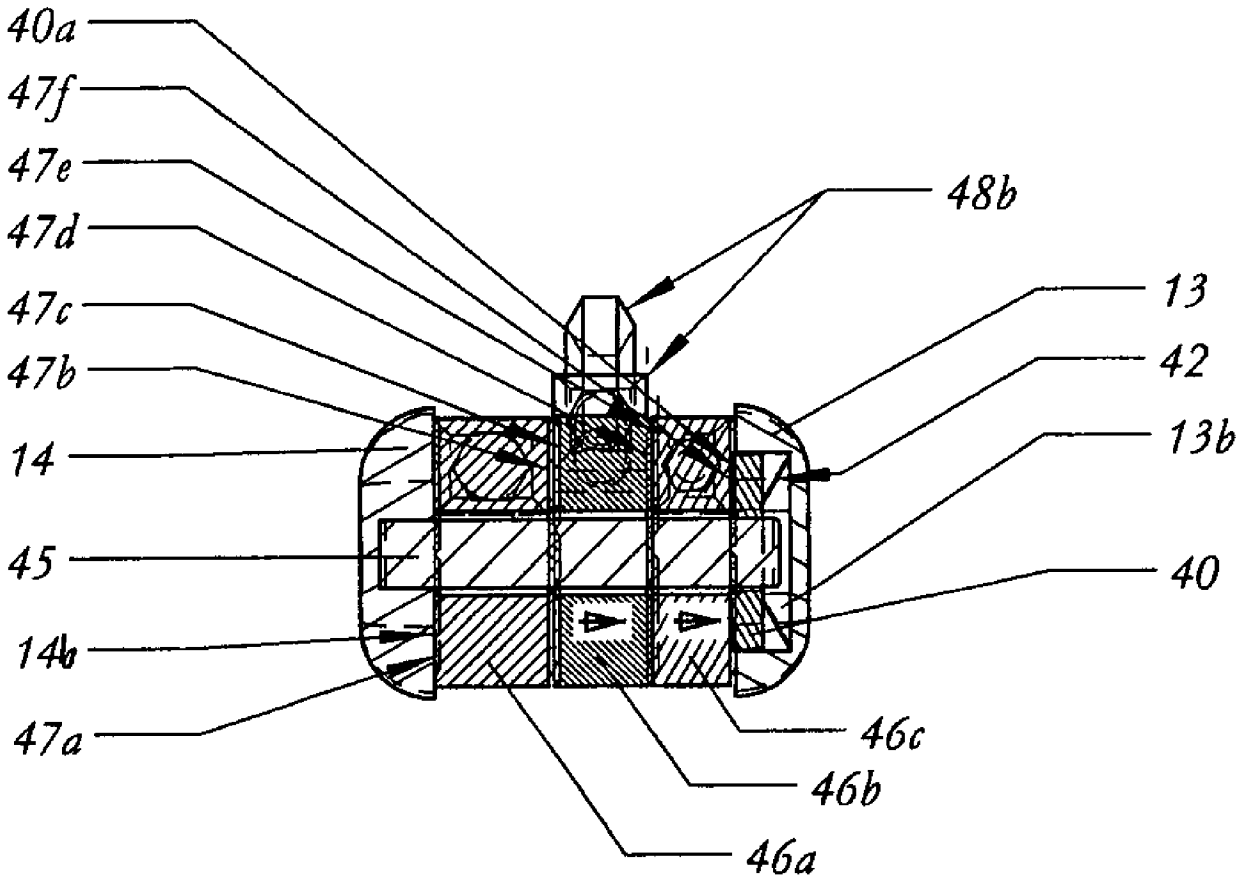
FIG. 14 is a sectional view of a Folding Hand Toolkit instrument with a sidewall lug detent locking mechanism in its unlocked position.

As shown in FIG. 14 the elongated lug-tool 48*b* is pivoted the ascending mating slopes of the raised or relief surfaces on sidewalls 47*b* with 47*c* and 47*d* with 47*e* will ride up one another. As they ride up one another they will apply a force in a linear direction along the axis of the stationary shaft. This applied force will cause an axial displacement of the pivoting extended lug-tool 48*b*. An equal and opposite force will be expressed by the handle section 14 in an axial direction along the stationary shaft 45. This force and resulting linear displacement will be transferred between all components in an axial direction along the stationary shaft 45 causing a displacement of the adjacent floating plate 40. The floating plate 40 will be displace in an axial direction along the stationary shaft and will transfer this applied linear force against the compression spring 42. As the extended lug-tool 48*b* continues to rotate the linear force applied to the compression spring is maintained until the slope on the opposite side of the raised or relief surfaces mate with a descending slope. The force stored in the compression spring will displace the floating plate and cause all affected components to come to rest and mate in the next defined detent, semi-secure and saddled position for the elongated lug-tool 48*b*. The angle of the slope for the raised and relief surfaces will be a factor based upon the leverage provided by the elongated lug-tool, compression force of the spring, shape and location of the raised and relief surfaces and desired resulting force that keeps an extended lug tool in its detent, semi-secure and saddled position.

Figure 15:
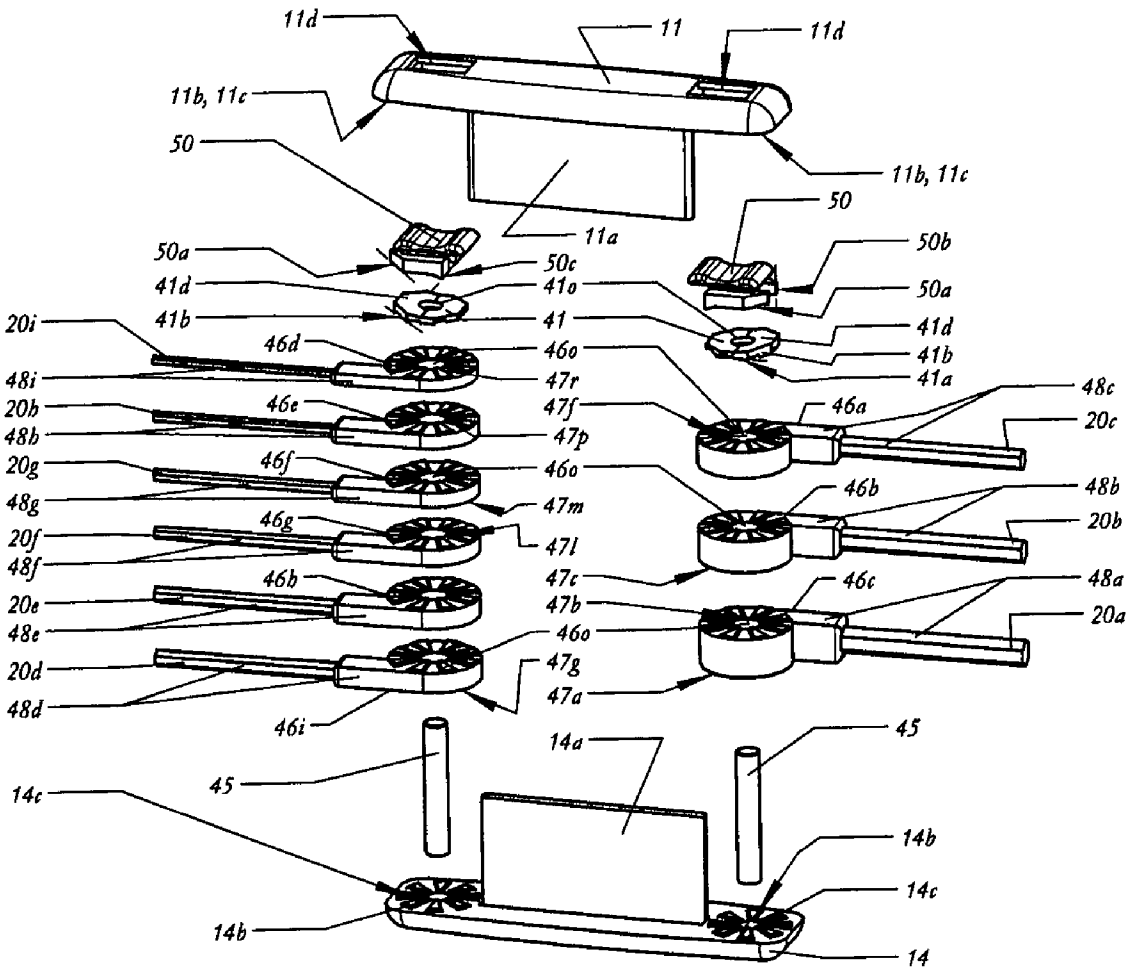
FIG. 15 is a detailed exploded view of a Folding Hand Toolkit instrument with a sidewall lug locking mechanism that utilizes a sliding lock.

FIG. 15 illustrates another embodiment of the present invention. FIG. 15 is an exploded isometric view and an example of a sliding locking mechanism that utilizes the sidewalls of the lugs 46*a* through 46*i*, handle sections 11 and 14 and floating plates 41 to create the locking device that positively locks each component between each adjacent component when placed under compression with the use of slide lock 50 that engages perpendicular to the compressed components.

It is shown that each lug 46*a* through 46*i* has geometry on each of the sidewalls 47*a* through 47*r*. This geometry has a raised surface, a relief surface or a combined raised and relief surface that is designed to mate with the adjacent lug of equal proportions and is also equipped with a mating raised and/or relief surface. Once positioned and pressed together the mating surfaces of each lug will engage with an adjacent lug. Each lug 46*a*, 46*b* and 46*c* are located on one side of the handles and lugs 47*d* through 47*i* are located on the opposite side of handles 13 and 14. All lugs are equipped with similar mating surfaces to that on the handle mating surfaces 14*b* and the floating plate mating surfaces 41*a*. When the mating surface handle 14*b* is pressed against an extended lug tool with a similar mating surface it will engage and provide a locking position that will secure the lug-tool from rotating to another position. When stacked and aligned, the mating surfaces of all lugs will engage directly and indirectly with the handle and floating plate so as not to rotate freely.

Floating plates 41 are of a polygon shape and each are equipped with similar sidewall mating surfaces 41*a* that when pressed together will engage with the adjacent lugs 47*a*, 47*b* and 47*c* on one side of the handle and 47*c* through 47*i* on the opposite side of the handle. The sidewalls 41*b* of the floating plates 41 can slide in a linear fashion along the axis of the shafts 45 and within the confines of the similar polygon shaped holes 11*b* of handle section 11. The sidewalls 11*c* of the polygon holes 11*b* are parallel when assembled with the sidewalls 41*b* of the floating plates 41. The polygon shape of the floating plates 41 situated within the confines of the polygon shaped holes 11*b* prevent the floating plates 41 from rotating.

When the Folding hand tool kit is assembled the slide lock 50 is fitted with the manual engagement protruding outwards through the opening in the slide channel 11*d* the floating plates 41 are placed into the confines of the polygon holes 11*b*. Extended lug-tools 48*a*, 48*b* and 48*c* are placed over floating plate 41 and the shaft 45 is inserted into the holes 46*o* that are located in the center of each lug and through the center hole 40*o* of the floating plate 40. Extended lug-tools 48*d* through 43*i* are placed over floating plate 40 and the shaft 45 is inserted into the holes 46*o* that are located in the center of each lug and through holes 41*o* of the floating plate 41. Handle section 14 is situated over the two stacks of extended lug-tools and fitted with the shafts 45 extending into the handle holes 14*c*. When all components are sandwiched together a press fit of handle web sections 14*a* and 11*a* are made and hold all components under compression and in place. Although other methods of holding handle web sections 14*a* and 11*a* can be employed.

Figure 16:
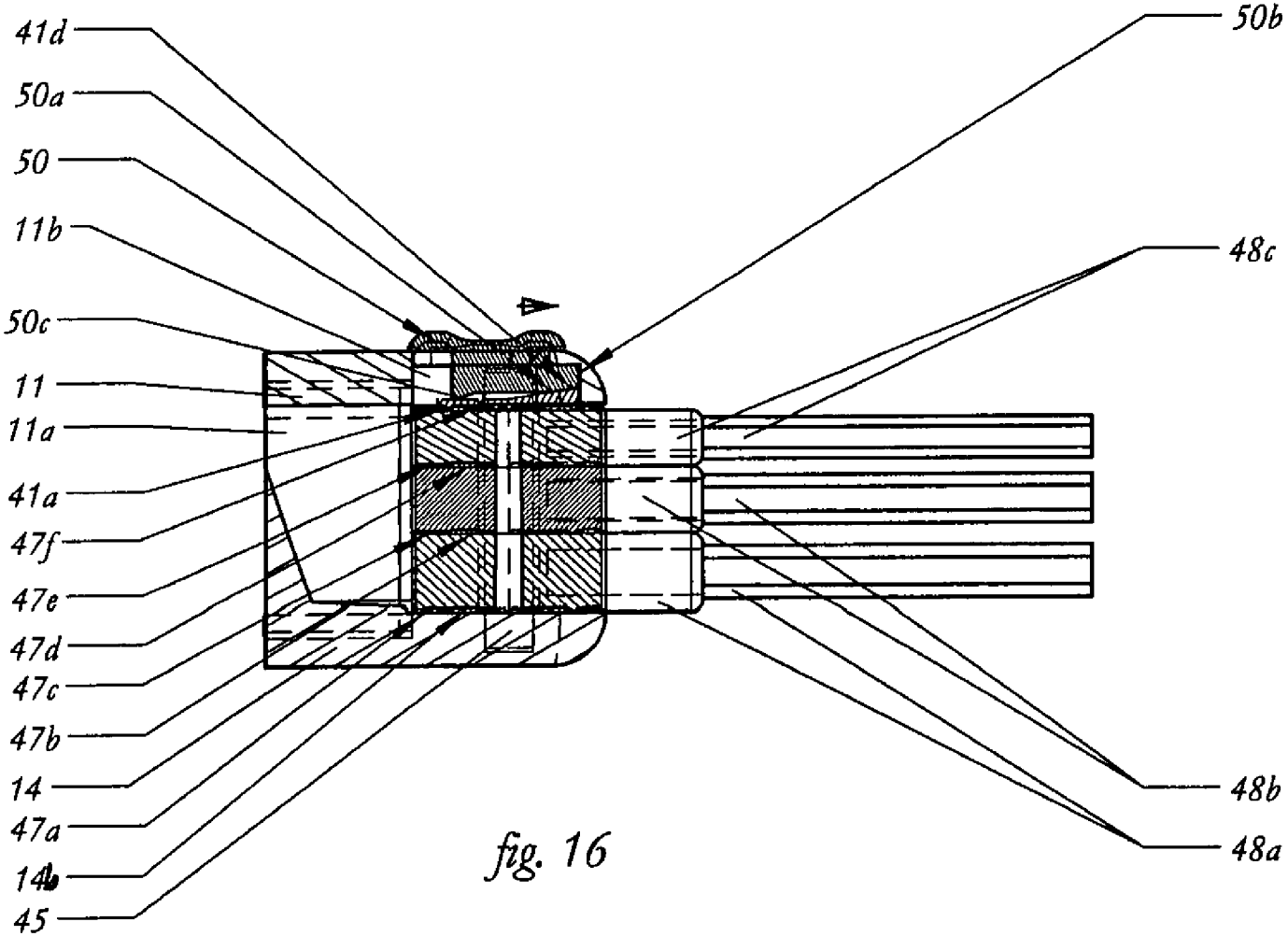
FIG. 16 is a sectional view of a Folding Hand Toolkit instrument with a sidewall lug locking mechanism in its locked position and that utilizes a sliding lock.

When all components are sandwiched together as shown in FIG. 16 and all mating surfaces of the lugs, handle and shafts are aligned with one another then all of the extended lug-tools are secured in place. The geometry that make up the surfaces 47*a* through 47*r* that is on each sidewall of each lug 46*a* through 46*i*, the surfaces 14*b* on the handle 14 and the surfaces 41*a* on the floating plates 41 have a raised surface, a relief surface or a combined raised and relief surface that is designed to mate with the adjacent lug of equal proportions and is also equipped with a mating raised and/or relief surface.

As shown in FIG. 16 when the slide lock 50 is pushed outwardly toward the end of the handle the slider slope 50*a* presses on the floating plate slope 41*d* forcing the floating plate 41 to travel in a linear direction along the axis of the shaft 45 and in a perpendicular direction to the sliding action of the slide lock 50. When the mating slopes of the raised or relief surfaces 47*a* to 47*f* of the extended lug-tools 48*a* to 48*c* are aligned with the mating slopes of the raised or relief surfaces or 14*b* of the handle section 14 and the mating slopes of the raised or relief surfaces 41*a* of the floating plate 41 and forced together by the linear action of the mating slopes of the slider slope 50*a* and floating plate slope 41*d* than all referenced components are positioned and able to be locked in place. The action of the slide lock 50 being pushed outward toward the end of the handle 11 also positions the slide lock foot 50*c* to come into contact with the floating plate 41 preventing any opposing forces to act against the sliding lock 50 while the extended tool is in use and thus preventing dislodging of the sliding lock 50.

Figure 17:
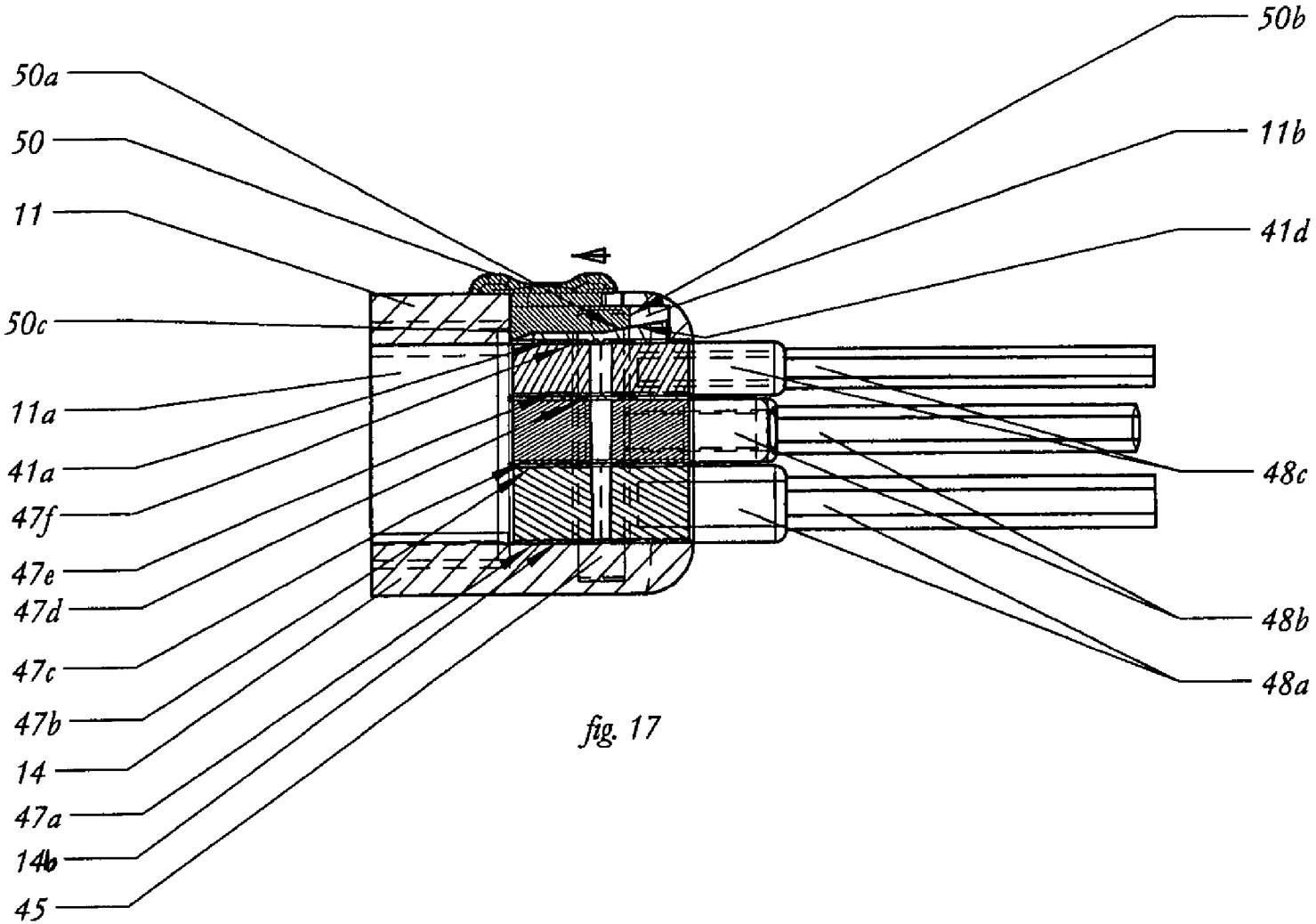
FIG. 17 is a sectional view of a Folding Hand Toolkit instrument with a sidewall lug locking mechanism in its unlocked position and that utilizes a sliding lock.

FIG. 17 shows the slide lock 50 pushed inward toward the center of the handle 11. When this action is taken the slide lock foot 50*c* is no longer in contact with the floating plate 41. The slider slope 50*a* is slid back permitting the floating plate to be displaced in a linear direction perpendicular to the direction of the slider lock action and allowing sufficient space to dislodge the raised or relief sidewall surfaces of all affected components and thus allowing for repositioning of the extended lug-tools.

FIGS. 18 and 19 illustrate the engaging and disengaging action of mating raised and relief surfaces. Illustrated in FIG. 18 is the sidewall 39*f* showing mating raised and relief surfaces of a lug 37*c* that are engaged with the sidewalls 40*a* that have similar mating raised and relief surfaces of floating plate 40. This engagement is typical of the Folding Hand Toolkit that incorporate sidewall locking mechanisms. When the sidewalls are engaged and held in compression or otherwise unable to be displaced or allow freedom to disengage than the extended lug-tool is said to be locked.

Illustrated in FIG. 19 is the sidewalls 39*f* showing mating raised and relief surfaces of a lug 37*c* that are not engaged with the sidewalls 40*a* that have similar mating raised and relief surfaces of floating plate 40. This non-engagement is typical of a Folding Hand Toolkit that incorporates sidewall locking mechanisms. When the sidewalls are disengaged and not held in compression or otherwise able to be displaced and allow freedom to disengage than the extended lug-tool is said to be unlocked.

Illustrated as an example in FIG. 18 and FIG. 19 the sidewalls 39*f* and 40*a* have sidewalls with raised or relief surfaces that have a slope 39*v* and 40*v* to their geometry. This slope provides the mechanical advantage of an incline plane or cam. When an elongated lug-tool is selected to be positioned for use or stored in its home position an operator will pivot the elongated lug-tool around the stationary shaft 45. The slopes of the raised and relief surfaces will ride along each other creating a linear displacement between components allowing for positioning of the extended lug-tools.

While the present invention has been described with respect to several different embodiments, it will be obvious that various modifications may be made without departing from the spirit and scope of this invention.

What is claimed is:

1. A folding hand tool comprising:

a handle section having a raised or relief surface geometry on an inner sidewall and a shaped hole formed in an opposing inner sidewall;

a plurality of elongated tools with each elongated tool having an extended tool working end and a lug aft end arranged adjacent to each other, the lug aft end having a mating raised or relief surface geometry and a through hole;

a floating plate having a hole and a mating raised or relief surface geometry placed between a lug aft end and said handle section within the shaped hole for selectively engaging or disengaging the mating raised or relief surface geometry on a lug aft end of one of said plurality of elongated tools;

means, associated with said handle section, for selectively displacing said floating plate axially within the shaped hole; and a shaft passing through the hole in said floating plate for mounting the lug aft end on said handle section in which any particular one of said plurality of elongated tools is selected by pivoting the particular one of said plurality of elongated tools around said shaft that is secured within the confines of said handle section and from a retracted closed position for storage within the confines of said handle section to an extended open position projecting outside the confines of said handle section for use, wherein the mating raised or relief surface geometry of the lug aft end can engage and disengage with the raised or relief surface geometry of said handle by selectively applying a bias force or removing a bias force for axially displacing said floating plate, and wherein a force greater than the bias that effects the engagement of said floating plate with the lug aft ends and the adjacent inner sidewall of said handle section is applied so as to permit said floating plate to be displaced in an axial direction within the shaped hole allowing sufficient displacement to permit said floating plate to disengage away from a lug aft end and subsequent lug aft ends and the inner sidewall of the handle section.

2. A folding hand tool as defined in claim 1 wherein:

the lug aft end of the elongated tool is manufactured as a separate operation than that of the extended tool and then combined with the extended tool to form an amalgamated elongated tool.

3. A folding hand tool as defined in claim 2 wherein:

the shape of the lug aft ends are the same.

4. A folding hand tool as defined in claim 3 wherein:

the shape of the sidewalls of the lug aft end have a contour geometry with raised and/or relief surfaces positioned to engage with or disengage from adjacent components by shifting in a lateral direction and is designed as a feature of a locking mechanism that can lock the extended tool in a plurality of locations extending in a radial direction for use.

5. A folding hand tool as defined in claim 3 wherein:

the shape of the sidewalls of the lug aft end have a contour geometry with raised and/or relief surfaces positioned to engage with or disengage from adjacent components by shifting in a lateral direction and is designed as a feature of a detent locking mechanism that allows the extended tool to be placed in a semi-secure position in a plurality of locations extending in a radial direction for use.

6. A folding hand tool as defined in claim 4 wherein:

said handle section of the folding hand tool has geometry with raised and/or relief surfaces positioned to engage with or disengage from the sidewalls of the lug aft end when the lug aft ends are shifted in a lateral direction for purposes of locking a lug aft end of an elongated tool in position for use.

7. A folding hand tool as defined in claim 4 wherein:

the lug aft end section of the folding hand tool has geometry with raised and/or relief surfaces positioned to engage with similar geometry on lug aft end sections of adjacent elongated tools by shifting in a lateral direction for purposes of locking a lug aft end of an elongated tool in position for use.

8. A folding hand tool as defined in claim 5 wherein:

said handle section of the folding hand tool has geometry with raised and/or relief surfaces positioned to engage with the sidewalls of the lug aft end for purposes of semi-securing the extended tool in a detent position for use.

9. A folding hand tool as defined in claim 5 wherein:

the lug aft end section of the folding hand tool has geometry with raised and/or relief surfaces positioned to engage with similar geometry on lug aft end sections of adjacent elongated tools for purposes of semi-securing the extended tool in a detent position for use.

10. A folding hand tool as defined in claim 5 wherein:

the raised and/or relief surfaces of the geometry that is designed to engage one component of a folding hand tool to the next has surfaces that form incline planes to aid as a mechanical advantage for positioning the elongated tool in position for use.

11. A folding hand tool as defined in claim 3 wherein:

the shape of the sidewalls of the lug aft end have a contour geometry with raised and/or relief surfaces positioned to engage with adjacent components and is designed as a feature of a sliding locking mechanism that allows the extended tool to be placed in a captured and secure position in a plurality of locations extending in a radial direction for use.

12. A folding hand tool as defined in claim 1 wherein:

said shaft that extends through the holes in the lug aft ends of the extended tools has a push button that extends through one side of the handle.

13. A folding hand tool comprising:

a handle section having a polygon shaped hole;

a plurality of elongated tools with each elongated tool having an extended tool working end and a lug aft end arranged adjacent to each other, the lug aft end having a through hole; and a shaft for mounting the lug aft end on said shaft that is mounted within the said handle section in which any particular one of said plurality of elongated tools is selected by pivoting the particular one of said plurality of elongated tools around said shaft that is secured within the confines of said handle section and from a retracted closed position for storage within the confines of said handle section to an extended open position projecting outside the confines of said handle section for use, a floating plate placed within the polygon shaped hole within said handle section and having a polygon shape matching the polygon shaped hole, a spring placed adjacent said floating plate within said polygon shaped hole so as to bias said floating plate towards a lug aft end, wherein the lug aft end is manufactured separately from the extended tool and by different means than that of the extended tool and than the extended tool is assembled combined with the lug aft end to form an amalgamated elongated lug tool that can better support load forces that are applied when using the extended tool, wherein the lug aft end of the elongated tool is manufactured as a separate operation than that of the extended tool and then combined with the extended tool to form an amalgamated elongated tool, wherein the shape of the lug aft end can take the form of a simple base designed to securely hold an extend tool and allow for its free rotation on said shaft within the confines of said handle section, wherein the shape of the sidewalls of the lug aft end have a contour geometry with raised and/or relief surfaces positioned to engage with adjacent components and is designed as a feature of a locking mechanism that can lock the extended tool in a plurality of locations extending in a radial direction for use, and wherein the lug aft end of the folding hand tool has geometry with raised and/or relief surfaces positioned to engage with similar geometry on said floating plate that are of a polygon shape which engages with the polygon shaped hole in said handle section to prevent said floating plate from rotating.

14. folding hand tool as defined in claim 4 wherein:

the raised and/or relief surfaces of the geometry that is designed to engage one component of the folding hand tool to the next has surfaces that form incline planes to aid as a mechanical advantage for positioning in a shifting motion when one inclined plane of one component rides along an adjacent incline plane of another component placing an elongated tool in position for use.

15. A folding hand tool comprising:

a handle section having a shaped hole;

a plurality of elongated tools with each elongated tool having an extended tool working end and a lug aft end arranged adjacent to each other, the lug aft end having a through hole; and a shaft for mounting the lug aft end on said shaft that is mounted within the said handle section in which any particular one of said plurality of elongated tools is selected by pivoting the particular one of said plurality of elongated tools around said shaft that is secured within the confines of said handle section and from a retracted closed position for storage within the confines of said handle section to an extended open position projecting outside the confines of said handle section for use, a floating plate placed within the shaped hole within said handle section and having a complementary shape matching the shaped hole, a spring placed adjacent said floating plate within said shaped hole so as to bias said floating plate towards a lug aft end, wherein the lug aft end is manufactured separately from the extended tool and by different means than that of the extended tool and then the extended tool is assembled combined with the lug aft end to form an amalgamated elongated lug tool that can better support load forces that are applied when using the extended tool, wherein the lug aft end of the elongated tool is manufactured as a separate operation than that of the extended tool and than combined with the extended tool to form an amalgamated elongated tool, wherein the shape of the lug aft end can take the form of a simple base designed to securely hold an extend tool and allow for its free rotation on said shaft within the confines of said handle section, wherein the shape of the sidewalls of the lug aft end have a contour geometry with raised and/or relief surfaces positioned to engage with adjacent components and is designed as a feature of a locking mechanism that can lock the extended tool in a plurality of locations extending in a radial direction for use, and wherein said shaft that extends through the holes in the lug base aft ends of the extended tools has a push button that extends through one side of said handle section and the other end of the push button mates with said floating plate that is on the opposite end of said handle section so when the push button is pressed it presses said floating plate that in turn compresses said spring and in turn allows the lug aft end to disengage from adjacent components and be repositioned.

16. A folding hand tool comprising:

a handle section having a shaped hole;

a plurality of elongated tools with each elongated tool having an extended tool working end and a lug aft end arranged adjacent to each other, the lug aft end having a through hole; and a shaft for mounting the lug aft end on said shaft that is mounted within the said handle section in which any particular one of said plurality of elongated tools is selected by pivoting the particular one of said plurality of elongated tools around said shaft that is secured within the confines of said handle section and from a retracted closed position for storage within the confines of said handle section to an extended open position projecting outside the confines of said handle section for use, a floating plate placed within the shaped hole within said handle section and having a complementary shape matching the shaped hole, wherein the lug aft end is manufactured separately from the extended tool and by different means than that of the extended tool and then the extended tool is assembled combined with the lug aft end to form an amalgamated elongated lug tool that can better support load forces that are applied when using the extended tool, wherein the lug aft end of the elongated tool is manufactured as a separate operation than that of the extended tool and than combined with the extended tool to form an amalgamated elongated tool, wherein the shape of the lug aft end can take the form of a simple base designed to securely hold an extend tool and allow for its free rotation on said shaft within the confines of said handle section, wherein the shape of the sidewalls of the lug aft end have a contour geometry with raised and/or relief surfaces positioned to engage with adjacent components and is designed as a feature of a locking mechanism that can lock the extended tool in a plurality of locations extending in a radial direction for use, a sliding locking mechanism formed in said handle and positioned to contact said floating plate so as to selectively move said floating plate laterally against or away from a lug aft end, whereby the lug aft ends are locked or unlocked, and wherein said shaft that extends through the holes in the lug aft ends of the extended tools has an extended shaft that extends through one side of said handle and the other end of said shaft extends through said floating plate that is on the opposite end of said handle section so when said sliding locking mechanism is slid forward it applies pressure to said floating plate that in turn allows the lug aft end to engage with adjacent components and be situated in a locked position.

17. A folding hand tool comprising:

a handle section having a polygon shaped hole;

a plurality of elongated tools with each elongated tool having an extended tool working end and a lug aft end arranged adjacent to each other, the lug aft end having a through hole; and a shaft for mounting the lug aft end on said shaft that is mounted within the said handle section in which any particular one of said plurality of elongated tools is selected by pivoting the particular one of said plurality of elongated tools around said shaft that is secured within the confines of said handle section and from a retracted closed position for storage within the confines of said handle section to an extended open position projecting outside the confines of said handle section for use, a floating plate placed within the polygon shaped hole within said handle section and having a polygon shape matching the polygon shaped hole, a spring placed adjacent said floating plate within said polygon shaped hole so as to bias said floating plate towards a lug aft end, wherein the lug aft end is manufactured separately from the extended tool and by different means than that of the extended tool and than the extended tool is assembled combined with the lug aft end to form an amalgamated elongated lug tool that can better support load forces that are applied when using the extended tool, wherein the lug aft end of the elongated tool is manufactured as a separate operation than that of the extended tool and then combined with the extended tool to form an amalgamated elongated tool, wherein the shape of the lug aft end can take the form of a simple base designed to securely hold an extend tool and allow for its free rotation on said shaft within the confines of said handle section, wherein the shape of the sidewalls of the lug aft end have a contour geometry with raised and/or relief surfaces positioned to engage with adjacent components and is designed as a feature of a detent locking mechanism that allows the extended tool to be placed in a semi-secure position in a plurality of locations extending in a radial direction for use, and wherein the lug aft end section of the folding hand tool has geometry with raised and/or relief surfaces positioned to engage with similar geometry on said floating plate section that are of a polygon shape which engages with the polygon shaped hole in said handle section to prevent said floating plate from rotating.

18. A folding hand tool comprising:

a handle having a shaped hole formed in an inner sidewall and a contoured surface on an opposing inner sidewall;

a plurality of plastic lugs having substantially similar diameters and a predetermined width pivotally mounted in said handle, each of said plurality of plastic lugs having parallel opposing sidewalls with a contoured surface adapted to mate with a complementary contoured surface of an adjacent sidewall;

a metal tool attached to each of said plurality of plastic lugs and adapted to selectively fold within said handle;

a shaped floating plate placed within the shaped hole, said shaped floating plate having a perimeter mating with a perimeter of the shaped hole and a complementary contoured surface mating with one of the contoured surfaces of said plurality of plastic lugs, whereby said shaped floating plate is prevented from rotating within the shaped hole; and a spring placed within said shaped hole biasing said shaped floating plate towards one of said plurality of plastic lugs, whereby relative rotational movement between said shaped floating plate and said plurality of plastic lugs is selectively prevented, whereby the substantially similar diameter of each of said plurality of plastic lugs provides a substantially uniform bearing surface for receiving forces transmitted by said metal tool during use.

19. A folding hand tool as in claim 18 further comprising:

a cam surface formed as part of the contoured surface and the complementary contoured surface, whereby said cam surface upon rotation causes axial displacement of one of said plurality of plastic lugs disengaging the contoured surface and the adjacent complementary contoured surface.

20. A folding hand tool comprising:

a handle;

a plurality of plastic lugs having substantially similar diameters and a predetermined width pivotally mounted in said handle, each of said plurality of plastic lugs having parallel opposing sidewalls with a contoured surface adapted to mate with a complementary contoured surface of an adjacent sidewall;

a metal tool attached to each of said plurality of plastic lugs and adapted to selectively fold within said handle; and selective locking means, associated with the parallel opposing sidewalls of each of said plurality of plastic lugs, for selectively locking each of said plurality of plastic lugs and attached metal tool into a predetermined angular position relative to said handle, whereby the substantially similar diameter of each of said plurality of plastic lugs provides a substantially uniform bearing surface for receiving forces transmitted by said metal tool during use, and wherein said selective locking means comprises:

a push button shaft extending through a lug hole in each of said plurality of plastic lugs and attached to said handle, said push button shaft having an extended shaft with a reduced diameter at one end;

a floating plate having a polygonal shape adapted to be received in a floating plate polygonal shaped hole in said handle;

a compression spring having a spring hole placed between said floating plate and the floating plate polygonal shaped hole, the spring hole having a diameter adapted to receive the reduced diameter of the extended shaft, whereby when said push button shaft is pushed, said compression spring is compressed releasing a biasing force on adjacent sidewalls permitting one of said plurality of plastic lugs and attached metal tool to be placed in an angular position relative to said handle.

21. A folding hand tool comprising:

a handle;

a plurality of plastic lugs having substantially similar diameters and a predetermined width pivotally mounted in said handle, each of said plurality of plastic lugs having parallel opposing sidewalls with a contoured surface adapted to mate with a complementary contoured surface of an adjacent sidewall;

a metal tool attached to each of said plurality of plastic lugs and adapted to selectively fold within said handle; and selective locking means, associated with the parallel opposing sidewalls of each of said plurality of plastic lugs, for selectively locking each of said plurality of plastic lugs and attached metal tool into a predetermined angular position relative to said handle, whereby the substantially similar diameter of each of said plurality of plastic lugs provides a substantially uniform bearing surface for receiving forces transmitted by said metal tool during use, and wherein said selective locking means comprises:

a shaft extending through a lug hole in each of said plurality of plastic lugs and attached to said handler a wedged shaped floating plate having a polygonal shape adapted to be received in a floating plate polygonal shaped hole in said handle;

a slider slope placed adjacent said wedge shaped floating plate; and a slide latch coupled to said slider slope and extending through said handle, whereby when said slide latch is moved, said slider slope pushes against said wedge shaped floating plate displacing said wedge shaped floating plate crating a force on adjacent sidewalls permitting one of said plurality of plastic lugs and attached metal tool to be selectively locked in an angular position relative to said handle.

22. A folding hand tool comprising:

a first handle having an inner sidewall surface having a raised or relief geometry;

a second handle having a shaped hole;

a plurality of lugs pivotally placed between said first and second handles, each of said plurality of lugs having parallel sidewalls with a mating interlocking surface;

a shaped floating plate having a surface mating with the mating interlocking surface of one of said plurality of lugs, placed between said second handle and one of said plurality of lugs and adapted to fit within the shaped hole, wherein said shaped floating plate is prevented from rotating within the shaped hole;

means, attached to said handle, for laterally displacing said floating plate axially within the shaped hole, whereby the surface of said shaped floating plate selectively engages or disengages from the mating interlocking surface of one of said plurality of lugs; and a tool attached to each of said plurality of lugs and adapted to fold within said handle, whereby each of said plurality of lugs provides a substantially uniform bearing surface for receiving forces transmitted by said tool during use and permits the shaped floating plate to selectively lock said tools in a desired angular orientation relative to said first and second handle.

23. A folding hand tool as in claim 22 wherein:

said means comprises a displaceable shaft on which said plurality of lugs rotate.

* * * * *